US012533546B2

(12) United States Patent
Copeland et al.

(10) Patent No.: US 12,533,546 B2
(45) Date of Patent: Jan. 27, 2026

(54) EXERCISE DEVICE AND METHOD OF USE

(71) Applicant: MyoPlatform Inc., Hillsburgh (CA)

(72) Inventors: Steve A. Copeland, Wasaga Beach (CA); Devyn Slocum, Orillia (CA); Nicholas Teixeira, Angus (CA); Tyler John Raul Loucks, Hillsburgh (CA); Brian Balogh, Mono (CA)

(73) Assignee: MYOPLATFORM INC., Hillsburgh (CA)

( * ) Notice: Subject to any disclaimer, the term of this patent is extended or adjusted under 35 U.S.C. 154(b) by 92 days.

(21) Appl. No.: 18/652,907

(22) Filed: May 2, 2024

(65) Prior Publication Data

US 2025/0339727 A1 Nov. 6, 2025

(51) Int. Cl.
*A63B 21/00* (2006.01)

(52) U.S. Cl.
CPC ..... *A63B 21/152* (2013.01); *A63B 21/154* (2013.01)

(58) Field of Classification Search
CPC ..... A63B 21/15; A63B 21/151; A63B 21/152; A63B 21/153; A63B 21/154; A63B 21/156; A63B 21/157; A63B 21/158; A63B 21/4033; A63B 21/4034; A63B 21/4037; A63B 23/03525
See application file for complete search history.

(56) References Cited

U.S. PATENT DOCUMENTS

| | | | | |
|---|---|---|---|---|
| 5,133,545 | A * | 7/1992 | Moschetti | A63B 21/153 482/110 |
| 5,304,104 | A * | 4/1994 | Chi | A63B 21/153 482/99 |
| 6,612,170 | B2 * | 9/2003 | Brown | A63B 21/4043 73/379.06 |
| 7,942,793 | B2 * | 5/2011 | Mills | A63B 21/015 482/130 |
| 10,894,577 | B2 | 1/2021 | Smith et al. | |
| 12,409,359 | B2 * | 9/2025 | Andrews | A63B 24/0062 |
| 2013/0090216 | A1 * | 4/2013 | Jackson | A63B 21/0442 482/52 |
| 2019/0300116 | A1 | 10/2019 | Smith et al. | |
| 2020/0030660 | A1 * | 1/2020 | Herring | A63B 21/4039 |
| 2020/0246655 | A1 * | 8/2020 | Gallagher | A63B 21/4043 |
| 2022/0184445 | A1 * | 6/2022 | Fortuin | A63B 24/0087 |
| 2022/0184452 | A1 * | 6/2022 | Valente | A63B 21/0058 |
| 2023/0405404 | A1 * | 12/2023 | Belsham | A63B 21/0058 |
| 2024/0058684 | A1 * | 2/2024 | Beom | A63B 24/0062 |
| 2024/0399188 | A1 * | 12/2024 | Chen | A63B 21/0058 |

* cited by examiner

*Primary Examiner* — Zachary T Moore
(74) *Attorney, Agent, or Firm* — Sand, Sebolt & Wernow Co., LPA

(57) ABSTRACT

An easily transportable exercise assembly has a platform housing that can support a user during an exercise. The exercise assembly has at least one gear system that has comprises a first face gear having a first plurality of concentric gear rings and a second face gear having a second plurality of concentric gear rings. There is a resistance mechanism within the platform housing. A first cable is operatively coupled with the first face gear and the resistance mechanism. A second cable is operatively coupled with the second face gear. The user of the exercise assembly manipulates an end of the second cable to experience a resistance in the second cable imparted from the resistance mechanism through the at least one gear system subassembly.

20 Claims, 13 Drawing Sheets

EXERCISE DEVICE AND METHOD OF USE

TECHNICAL FIELD

This disclosure is directed to an exercise device and its method of use.

BACKGROUND ART

It is well known that regular exercise offers a plethora of health benefits that positively impact human well-being. Engaging in physical activity helps prevent excess weight gain and assists in maintaining lost weight. Exercise plays a role in combating various health conditions and diseases. Exercise also has a positive impact on mood, physical stamina, and improved sleep patterns, amounts other benefits.

Exercising with free weights provides several benefits. When a person uses dumbbells, barbells, or kettlebells, the person exercising will typically engage more muscles during exercises. For instance, a dumbbell shoulder press not only targets muscles in the shoulders but also activates core, traps, and triceps as they stabilize the person's body. Additionally, free weights promote functional fitness by mimicking real-life movements. These free weights are useful when they are in a unique location, such as a gym. However, these free weights are typically too heavy and take up too much space to transport to different locations.

Exercising with weight machines also has advantages. These machines are particularly useful for beginners because they guide the proper form and reduce the risk of injury. The fixed range of motion ensures that the person exercising maintains the correct alignment during exercises. Weight machines are also beneficial for isolating specific muscles. Although these machines are beneficial, they are extremely heavy and often too large for one person to move.

With continued reference to weight machines, instead of a weight stack, some machines use resistance bands. These machines with resistance bands require the person exercising to change many bands and these bands do not provide (i) simple adjustment in resistance levels, or (ii) the heavier resistance force required for weight training. This is typically over 100 pounds for each hand. Magnetic resistance has been used in a few cable resistance exercise machines, but they also cannot reach the required pound force without significant weight and cost, using rare earth magnets or by utilizing electromagnets. There are some pneumatic and hydraulic cable resistance exercise machines, but these are used in permanent gym installations as they are very large and heavy.

Based on the large size and heavy weight, none of these mechanisms allow for a single person to easily move or transport their resistance exercise system to use at a different location. For example, in a park, a small apartment/condominium or while travelling.

SUMMARY OF THE INVENTION

Thus, what is needed is an improved exercise platform that can be easily transported but still provide the necessary higher levels or heavier resistance for weight training. The present disclosure addresses these and other issues by providing an exercise platform that utilizes a combination of gears, cables, a piston and cylinder to generate heavy resistance loads in a transportable platform. One embedment of the platform of the present disclosure has size dimensions or parameter will fit into a typical sedan automobile.

One embodiment of the resistance exercise platform includes two cable resistance force systems. Each of the two cable resistance force systems includes a cog roller-toothed gear assembly coupled to one end of a drive or pinion shaft and a second cog roller-toothed gear assembly coupled to the other end of the drive or pinion shaft, where the cog roller-toothed gear assemblies mesh with two front face concentric gear rings having plain ring bearings (and not roller bearings). The cable resistance force system includes a tension gas strut (e.g., a pneumatic strut) and two hoists with pulleys.

The back end of the tension gas strut is secured to the frame of the platform. A cable is wound around the first concentric gear ring, with three gear tooth rings or levels. The cable then extends or runs through the pulleys in a first hoist that is attached to the wall and through the pulleys in a second hoist that is attached to one end (e.g., the front) of the gas strut. This greatly increases the draw length of the cable relative to the extension of the tension gas strut.

The second concentric gear ring, with thirteen tooth gear rings or levels, has another cable wound around it that runs through a pulley that is attached to the frame and the end of the cable is attached to a hand grip or handle on the exterior of the platform.

The second cable resistance force system mirrors that which has been described above but is located on an opposite side of the platform.

Each of the two cable resistance force systems has a resistance adjustment system that has a first lever to slide the first cog roller-toothed gear assembly along the drive or pinion shaft. This will adjust the force level from low to medium and to high settings on the three tooth levels on the first tooth ring. The second lever will slide along the drive or pinion shaft to adjust the force level from one through thirteen settings on the thirteen tooth gears or levels on the second tooth ring.

Each lever is attached to a gear brake on each of the concentric gear rings. When the lever is pushed forward to be adjusted, it will engage the gear brake to ensure the gear rings do not rotate. This will ensure the cables do not unwind from the gears.

In one aspect, an exemplary embodiment of the present disclosure may provide an exercise assembly comprising: a platform housing comprising a top platform surface adapted to be stood upon by a user of the exercise assembly, wherein the platform housing defines an internal volume; a frame that supports the platform housing; at least one gear system subassembly within the platform housing, wherein the at least one gear system subassembly comprises a first face gear having a first plurality of concentric gear rings and a second face gear having a second plurality of concentric gear rings, wherein the first face gear and the second face gear are in operative communication with each other via a pinion driveshaft; a resistance mechanism within the platform housing; a first cable operatively coupled with the first face gear and the resistance mechanism; and a second cable operatively coupled with the second face gear, and an end of the second cable adapted to be manipulated by the user of the exercise assembly to experience a resistance in the second cable imparted from the resistance mechanism through the at least one gear system subassembly.

This exemplary embodiment or another exemplary embodiment may further provide that the concentric gear rings on the first face gear and the concentric gears on the second face gear face the same direction. This exemplary embodiment or another exemplary embodiment may further provide that the concentric gear rings on the first face gear and the concentric gears on the second face gear are oriented in the vertical direction such that first face gear rotates about a first vertical axis and the second face gear rotates about a second vertical axis that is parallel to the first vertical axis.

This exemplary embodiment or another exemplary embodiment may further include a first pinion on the pinion driveshaft, wherein the first pinion engages the first face gear; a second pinion on the pinion driveshaft, wherein the second pinion engages the second face gear; wherein rotation of the second face gear imparts rotation to the second pinion gear that imparts rotation to the pinion driveshaft, and the pinion driveshaft thereby imparts rotation to the first pinion that imparts rotation to the first face gear.

This exemplary embodiment or another exemplary embodiment may further include a first pinion on the pinion driveshaft, wherein the first pinion selectively engages the first face gear at one of gear ring in the first plurality of concentric gear rings; a second pinion on the pinion driveshaft, wherein the second pinion selectively engages the second face gear at one of gear ring in the second plurality of concentric gear rings.

This exemplary embodiment or another exemplary embodiment may further include a brake shaft operatively coupled to pinion driveshaft, wherein the brake shaft is spaced apart and parallel to the pinion driveshaft. This exemplary embodiment or another exemplary embodiment may further include a first brake fixedly connected to the brake shaft, wherein the first brake selectively engages the first face gear to lock with the first face gear and selectively disengages the first face gear to unlock from the first face gear, wherein a first pinion is selectively moved between the plurality of first concentric gear rings when the first brake is unlocked. This exemplary embodiment or another exemplary embodiment may further include a second brake fixedly connected to the brake shaft, wherein the second brake selectively engages the second face gear to lock with the second face gear and selectively disengages the second face gear to unlock from the second face gear, wherein a second pinion is selectively moved between the plurality of second concentric gear rings when the second brake is unlocked.

This exemplary embodiment or another exemplary embodiment may further include an adjustable and user-selected gear ratio of the first face gear relative to the second face gear depending on a user-selected engagement position of a first pinion with the first face gear and a user-selected engagement position of a second pinion with the second face gear, wherein the resistance from the resistance mechanism that is experienced by the user of the exercise assembly depends on the gear ratio.

This exemplary embodiment or another exemplary embodiment may further include wheels coupled to the platform housing, wherein the wheels enable the platform housing to be rolled and transported to a different location.

This exemplary embodiment or another exemplary embodiment may further include a second gear system subassembly within the platform housing, wherein the second gear system subassembly comprises a third face gear having a third plurality of concentric gear rings and a fourth face gear having a fourth plurality of concentric gear rings, wherein the third face gear and the fourth face gear are in operative communication with each other via a second pinion driveshaft; a second resistance mechanism within the platform housing; a third cable operatively coupled with the third face gear and the second resistance mechanism; and a fourth cable operatively coupled with the fourth face gear, and an end of the fourth cable adapted to be manipulated by the user of the exercise assembly to experience a resistance in the fourth cable imparted from the second resistance mechanism through the second gear system subassembly.

This exemplary embodiment or another exemplary embodiment may further include a pulley assembly within the platform housing, wherein the first cable is strung through a first plurality of pulleys and the second cable is strung through a second plurality of pulleys. This exemplary embodiment or another exemplary embodiment may further include one end of the resistance mechanism fixed connected to the frame within the platform housing; an opposing end of the resistance mechanism coupled to some of the pulleys from the first plurality of pulleys, wherein the resistance mechanism is a gas strut that moves between a collapsed position and an extended position in response to movement of the first cable having been driven by the at least one gear system subassembly. This exemplary embodiment or another exemplary embodiment may further include that the gas strut is oriented horizontally relative to a ground surface when the platform housing is placed on the ground surface.

This exemplary embodiment or another exemplary embodiment may further include a first aperture formed in the top platform surface of the platform housing; wherein a portion of the at least one gear system subassembly extends through the first aperture formed in the top surface, wherein the portion of the at least one gear system subassembly that extends through the first aperture is configured to enable a gear-ratio of the first face gear to the second face gear to be changed based on user-selected preference.

This exemplary embodiment or another exemplary embodiment may further include a radial spherical plain bearing on one of the first pinion and the second pinion.

In yet another aspect, another exemplary embodiment of the present disclosure may provide a method comprising: standing near or upon a platform housing of an exercise assembly comprising at least one within the platform housing, wherein the at least one gear system subassembly comprises a first face gear and a second face gear, and the exercise assembly comprising at least a first cable and a second cable; pulling the second cable outwardly through a hole formed in the platform housing; rotating the second face gear in response to pulling the second cable; rotating a second pinion with the second face gear; rotating a pinion driveshaft in response to rotation of the second pinion; rotating a first pinion connected to the pinion driveshaft; rotating the first face gear in response to rotation of the first pinion; causing the first cable to pull against a resistance mechanism, when the second cable is manipulated by the user of the exercise assembly, the user experiences resistance in the second cable imparted from the resistance mechanism through the at least one gear system subassembly.

This exemplary embodiment or another exemplary embodiment may further include changing a gear ratio of the first face gear to the second face gear in response to one of (i) moving the first pinion along the pinion driveshaft to engage another concentric ring gear on the first face gear, (ii) moving the second pinion along the pinion driveshaft to engage another concentric ring gear on the second face gear, or (iii) both (i) and (ii).

This exemplary embodiment or another exemplary embodiment may further include disengaging a first brake from the first face gear; moving the first pinion along the pinion driveshaft when the first brake is disengaged; re-engaging the first brake after moving the first pinion to a different position along the pinion driveshaft.

This exemplary embodiment or another exemplary embodiment may further include imparting rotation to a radial spherical plain bearing on the second pinion in response pulling the second cable; and imparting rotation to a radial spherical bearing on the first pinion in response to rotation of the pinion driveshaft.

In yet another embodiment, there is an easily transportable exercise assembly that has a platform housing that can support a user during an exercise. The exercise assembly has at least one gear system that has comprises a first face gear having a first plurality of concentric gear rings and a second face gear having a second plurality of concentric gear rings. There is a resistance mechanism within the platform housing. A first cable is operatively coupled with the first face gear and the resistance mechanism. A second cable is operatively coupled with the second face gear. The user of the exercise assembly manipulates an end of the second cable to experience a resistance in the second cable imparted from the resistance mechanism through the at least one gear system subassembly.

BRIEF DESCRIPTION OF THE DRAWINGS

One or more exemplary embodiment(s) of the present disclosure is set forth in the following description, is shown in the drawings and is particularly and distinctly pointed out and set forth in the appended claims. The accompanying drawings, which are incorporated in and constitute a part of the specification, illustrate various example configurations and methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

The figures depict an exercise platform assembly generally at 1, which may be generally referred to as assembly 1. Assembly 1 is an exercise platform that can be easily transported yet also provides levels of heavier resistance for weight training. Assembly 1 includes a platform housing 102 that has a generally rectangular box-like configuration defining an internal volume that stores the resistance generating components of the assembly 1.

Figure 1:
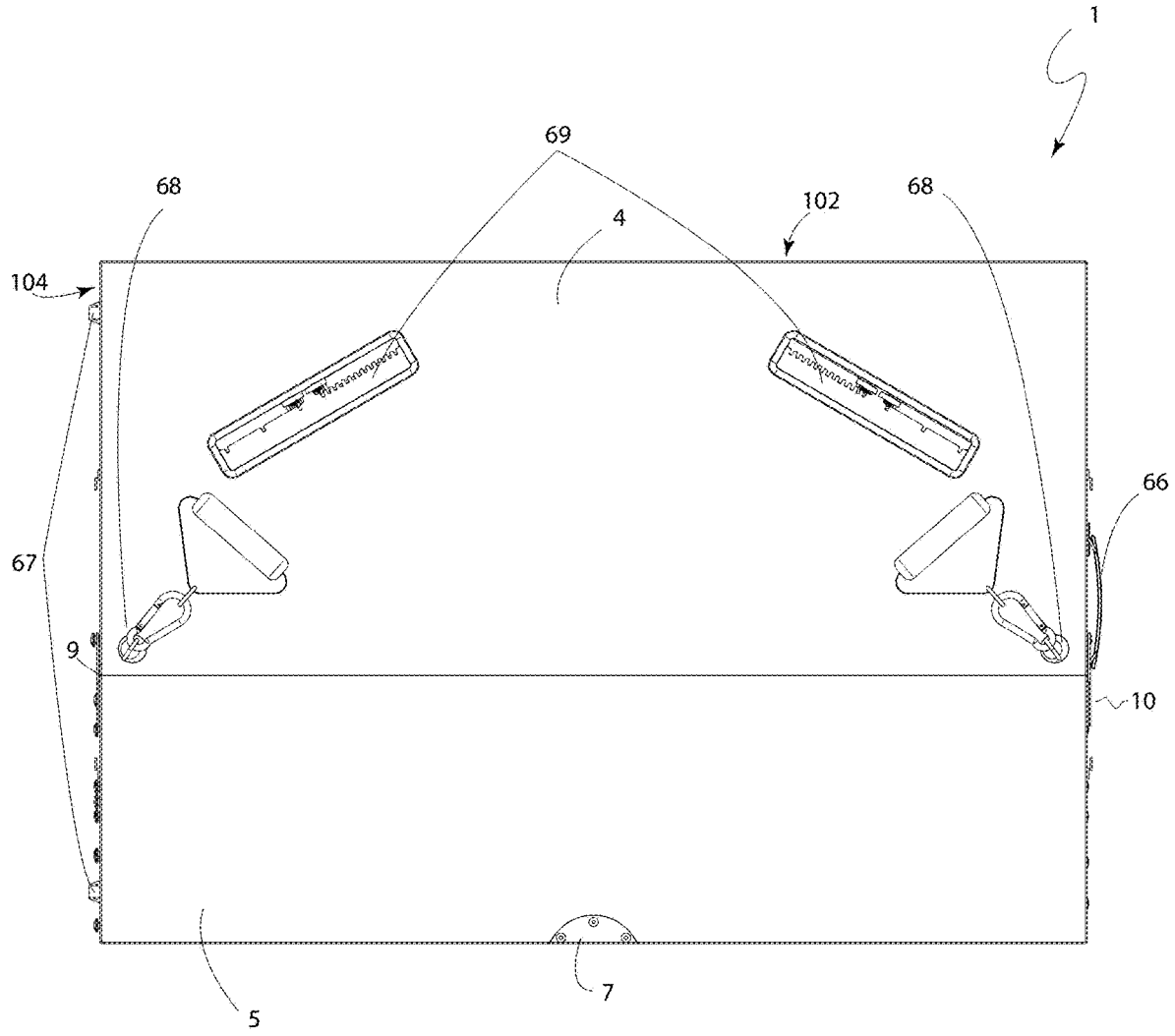
FIG. 1 is a top plan view of a resistance exercise platform according to one embodiment of the present disclosure.
Figure 1A:
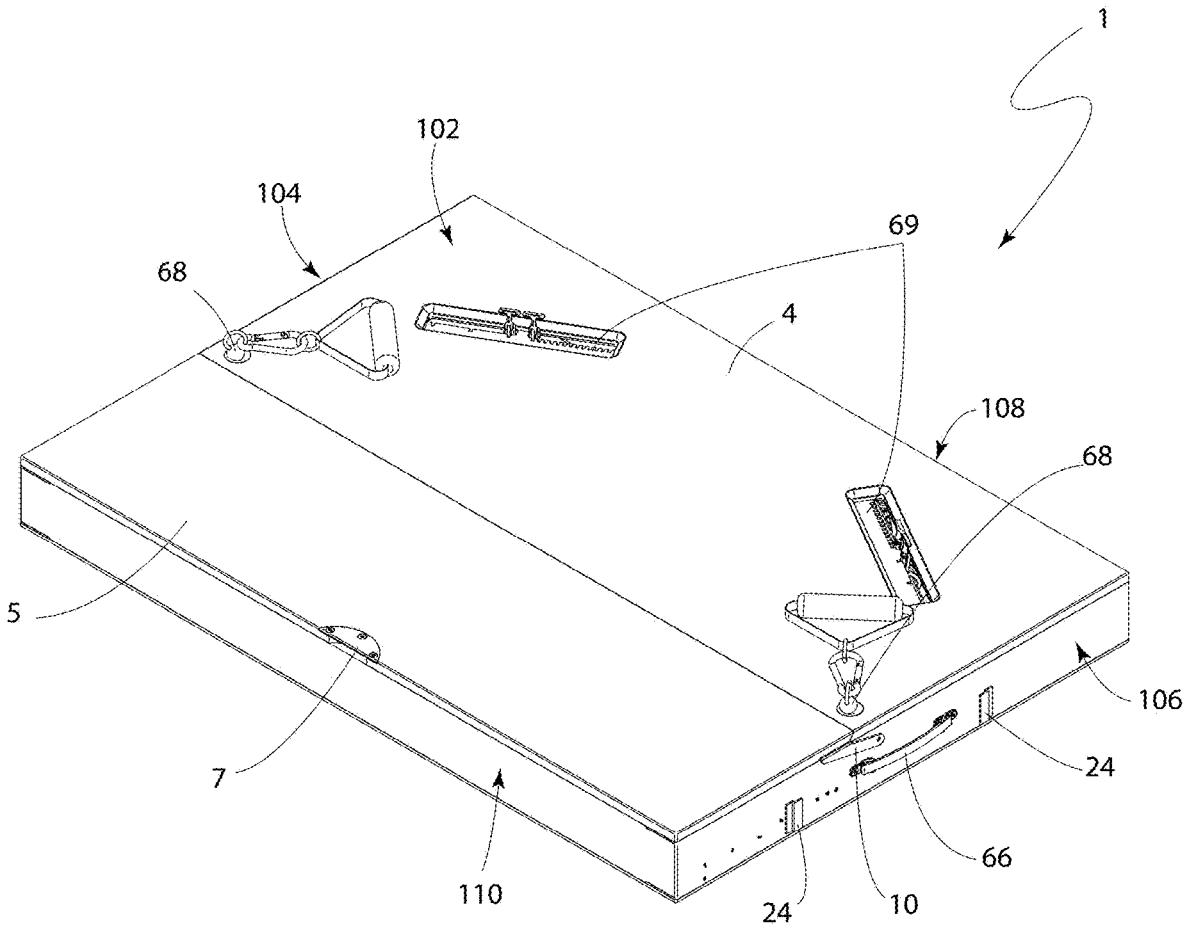
FIG. 1A is an isometric top perspective view of the resistance exercise platform.

FIG. 1 and FIG. 1A depict that platform housing 102 includes a top platform surface 4 and a bottom surface 6, or simply a floor 6, that define a vertical direction therebetween. Platform housing 102 includes a first side surface 104 (e.g., a left surface) and a second side surface 106 (e.g., a right surface) that define a lateral direction therebetween. The lateral direction is orthogonal to the vertical direction. Platform housing 102 includes a front surface 108 and a rear surface 110 that define a transverse direction therebetween. The transverse direction is orthogonal to the vertical direction and the transverse direction.

Platform housing 102 may be fabricated from any suitable material capable of supporting the weight or mass of the user thereon. In one particular embodiment, some portions of the platform, such as the top platform surface 4 is fabricated substantially from bamboo. One exemplary advantage of utilizing bamboo is it is lightweight thereby making it relatively easy to transport yet still strong enough to allow a user to stand upon the top platform surface 4. Stated otherwise, the platform housing 102 is configured to be placed upon the ground with the bottom surface 6 engaging or being supported by the ground and the user stands atop the platform housing 102. The side surfaces 104, 106 and the front and rear surfaces 108, 110 extend upwardly from the bottom surface 6 to elevate the top platform surface 4 above the ground and above the resistance generating components within the internal volume of the platform housing 102.

Top platform surface 4 may be divided into a fixed panel and a moveable panel defining a door 5. The door 5 is movable relative to the fixed panel. In one particular embodiment, a left side hinge 9 is connected to the left side of the door 5 and a right side hinge 10 is connected to the right side of the door 5. In one particular embodiment, the left side hinge 9 is also connected to the left side surface 104 and the right side hinge 10 is also connected to the right side surface 106. However, it is entirely possible that the hinges 9,10 be coupled to the fixed panel of top platform surface 4 instead of the side surface 104, 106. The hinges permit the door 5 to pivot about an axis that extends parallel to the lateral direction. In one embodiment, the door 5 has a first dimension measured in the transverse direction. The first dimension is less than a second dimension of the fixed panel that is measured in the transverse direction. As such, a majority of the total dimension of top panel surface 4 that is measured in the transverse direction is defined by the fixed panel and a minority of the total dimension of the top panel surface 4 is defined by the door 5. Door 5 provides access to the internal volume of the platform housing when it is opened. The door may include a handle 7 to assist with opening and closing the door 5, which may also operate as a lid to thereby define a lid subassembly 70. Door 5 pivots about the pivot axis, via hinges 9,10, in response to user manipulation of the door 5 via handle 7. Below the door 5 may be a space to store extra components of the assembly 1 or secondary components, such as extra handles 78, or gloves for a user to wear and/or towels etc.

The fixed panel of the top panel surface 4 may defined a plurality of apertures that extend entirely through the body of the top panel surface in the vertical direction. Components of the assembly 1 may be disposed within or extend through these apertures as detailed herein. For example, there may be an accessory attachment point 68. In this example, there are two attachment points 68, each attachment point associated with or corresponding to one side (either the left or the right) of the top panel surface 4. The attachment point 68 is configured to connect or attach with an accessory that is used in conjunction with the assembly. In the shown example, a handle 78 is connected to the attachment point.

FIG. 1 and FIG. 1A depict that the assembly 1 may also include a grip handle 66 that is used to carry the platform housing 102. The grip handle 66 makes the platform housing 102 easily transportable. The grip handle 66 may be located on the right or second side surface 106 of the platform housing 102. Opposite the handle 66, on the first side surface 104, may be one or more wheels 67. The wheels 67 may rotate about an axis extending parallel to the transverse direction between the front surface 108 and the rear surface 110. Wheels 67 extend outwardly from the first side surface 104 and allow the user to roll the assembly 1 while pulling with the handle 66.

With continued reference to FIG. 1 and FIG. 1A, the apertures formed in the fixed panel of the top platform surface 4 have a weight adjustment control 69 located therein. The weight adjustment control will be described in greater detail with respect to the gear system subassembly 27. However, as an introductory comment, it is to be understood that the weight adjustment control 69 includes a portion thereof that extends through the apertures in the fixed panel of the top platform surface 4 which allow a user to selectively adjust the amount of resistance that is to be provided by the gear system subassembly 27 and the pulley assembly 52 when completing an exercise device by pulling on handle 78 when standing atop the platform surface 4.

Figure 2:
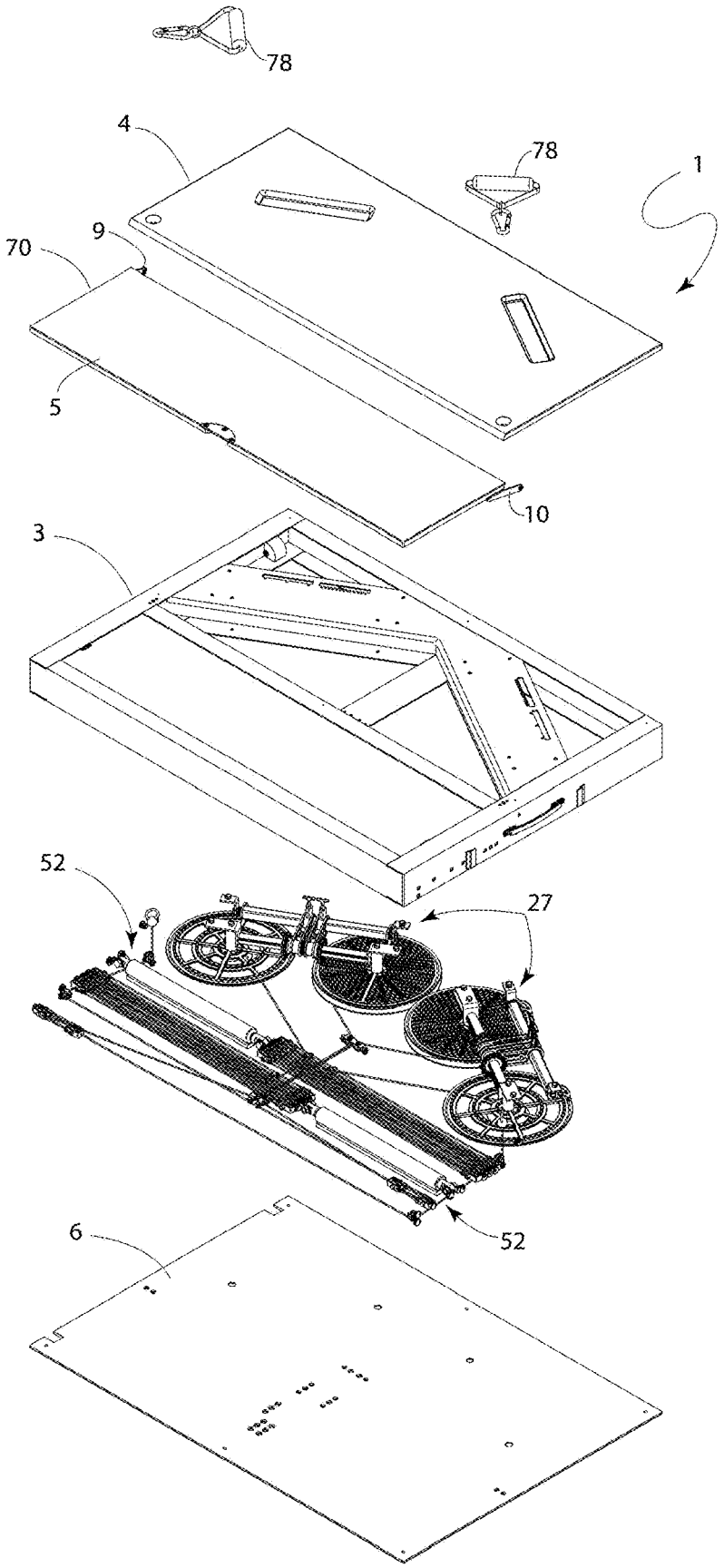
FIG. 2 is an exploded top perspective view of the resistance exercise platform.

FIG. 2 is an exploded perspective view of the assembly 1. Within the internal volume of the platform housing 102 is the frame substructure 3, a gear system subassembly 27, and a pulley assembly 52. The frame substructure provides structural support to the platform housing 102 during operation of the gear system subassembly 27 and the pulley assembly 52. The gear system subassembly 27 and the pulley assembly 52 cooperate to provide a resistance or resistive force when a user is interacting with assembly 1 to perform an exercise.

Figure 3:
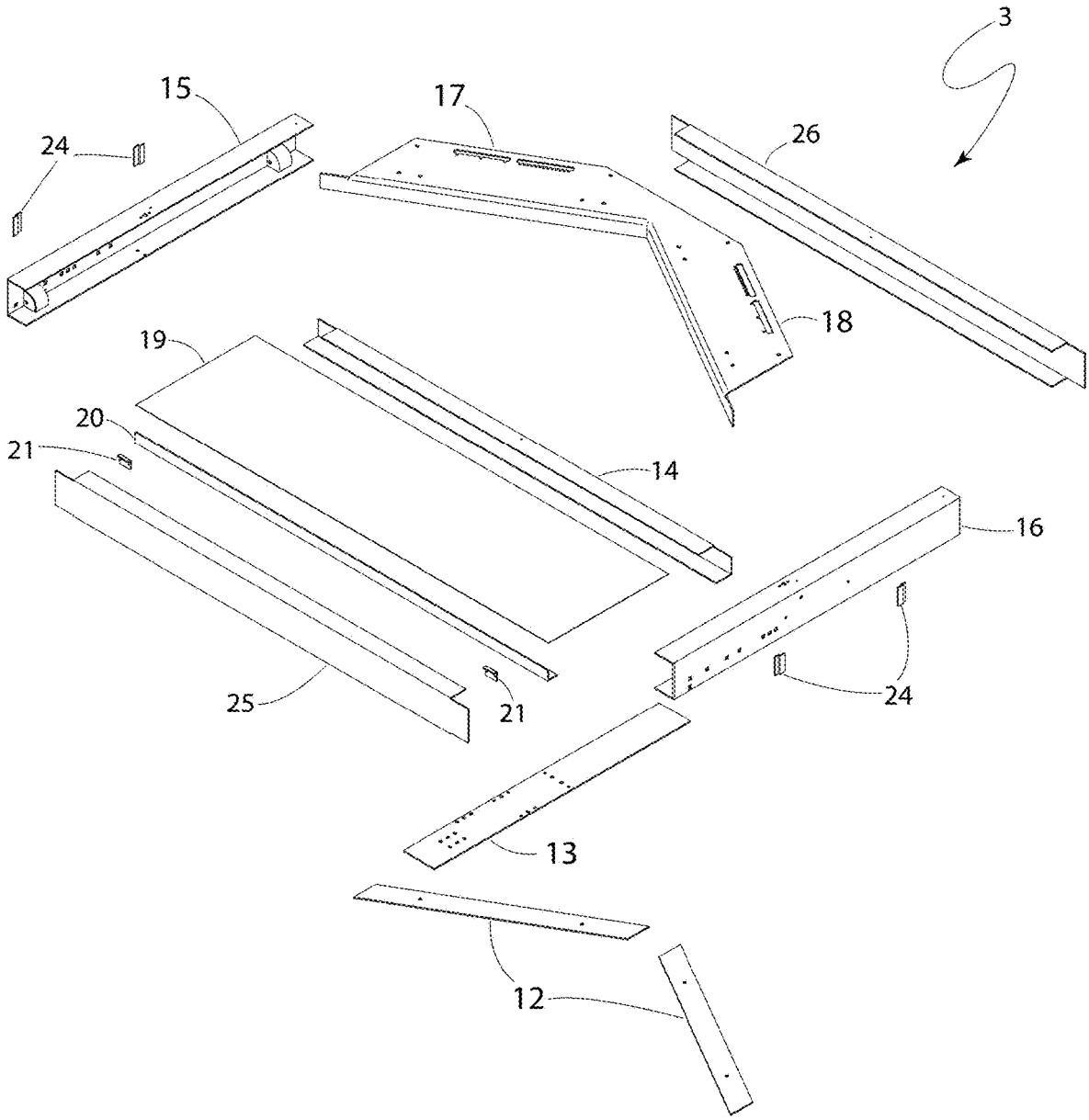
FIG. 3 is an exploded perspective view of the frame that is part of the resistance exercise platform.

FIG. 3 depicts that frame 3, which is located within the internal volume of the platform housing 102, may include bottom angle supports 12, a bottom support 13, a crossbar 14, a left member 15, a right member 16, a slotted left crossbar 17, a slotted right crossbar 18, a bottom tray 19, a tray support 20, a latch bracket 21, a rack attachment 24, a frame rear member 25, and a frame front member 26. These components of the frame 3 may be welded together to form a welded frame substructure located within the internal volume of the platform housing 102. The frame 3 may also support the gear system subassembly 27 and the pulley assembly 52 as will be described in greater detail herein.

Left member 15 of frame 3 includes a forward end spaced apart from a rear end defining a length of the left member 15 extending there between. Frame left member 15 is a generally rigid elongated C-shaped member positioned at and defining the left side surface 104 of the platform housing 102. The exterior surface of the left member faces outwardly from the platform housing 102 and the right side surface of the left member 15 faces the internal volume of the platform housing 102. In one particular embodiment, left member 15 is generally C-shaped in cross section. Left member 15 may also include wheel retention points that receive and enable the wheels 67 to be mounted thereon. In one embodiment, the rack attachment 24 is connected to the exterior surface of the left member 15. Left member 15 has a length measured in the transverse direction extending from the forward end of the left member to the rear end of the left member. The length of the left member 15 measured in the transverse direction is greater than the vertical dimension of the left member and greater than the lateral dimension of the left member 15.

Right member 16 is shaped largely similar to the left member 15. However, right member 16 does not include the wheel attachment points inasmuch as the wheels 67 are only attached to the left member 15. As such, right member 16 includes a forward end spaced apart from a rear end, wherein a length of the right member 16 extends in the transverse direction between the front end and the rear end of the frame right member. Right member 16 may also generally be C-shaped in cross section wherein an exterior surface of the frame right member defines the second side surface 106 of the platform housing 102. An interior surface of the right member 16 faces the internal volume of the platform housing 102.

Frame front member 26 is an elongated member that extends in the lateral direction between the forward ends of the left member 15 and the right member 16. As such, front member 26 includes a left end and a right end. The right end of the frame front member 26 is connected to the forward end of the frame right member 16. The left end of the frame front member 26 is connected to the forward end of the frame left member 15. The length of the front member 26 extends in the lateral direction between its left end and its right end. In one particular embodiment, the frame front member has an interior surface that faces the internal volume of the platform housing 102. The exterior surface of the frame front member faces away from the internal volume of the platform housing 102 and the exterior surface of the front member 26 may define the front surface 108 of the platform housing 102. Frame front member 26 is welded to the left member 15 and the right member 16 in the orientation herein described to create a rigid connection therebetween.

Frame rear member 25 is shaped largely similar to the front member 26 except that it extends laterally between the rear ends of the frame left member 15 and frame right member 16. The frame rear member 25 includes an exterior surface that defines the rear surface 110 of the platform housing 102. The left end of the frame rear member 25 is connected with the rear end of the left member 15 and the right end of the rear member 25 is connected with the rear end of the right member 16.

The crossbar 14 of the frame 3 extends laterally between the left member 15 and the right member 16 intermediate of their respective forward and rear ends. Crossbar 14 has a lower flange that couples to and supports the bottom tray 19. The bottom tray 19 is located closer to the rear ends of the left and right members 15, 16 than the crossbar 14. Tray 19 is a generally rectangular plate also supported by the lower flange of the left and right members 15, 16. The rear end of the bottom tray is connected with the tray support 20 that extends in the lateral direction between the left member 15 and the right member 16 to support the tray 19. Latch brackets may also be coupled to either the rear member 25 or the tray support 20 that assists to latch closed the door 5 when it is in its closed position. Bottom support 13 of the frame 3 may also extend centrally in the transverse direction between the rear member 25 and the rear member 26. Bottom support 13 has a rear end that is connected with the rear member 25 between its left and right ends. Bottom support 13 includes a forward end that is connected to the front member 26 between its left and right ends. Angle supports 12 may be connected to the bottom support and extend outwardly from the central connection at an angle between zero degrees and 180 degrees.

The slotted left crossbar 17 and the slotted right crossbar 18 may be formed as a singular unit, as shown in FIG. 3. However, it is to be understood that the slotted crossbars may also be independent and distinct components instead of part of the welded frame 3. Left crossbar 17 includes a left end that is coupled with the left member 15. Left crossbar 17 terminates at a forward end that is connected with the front member 26. The left crossbar extends at a diagonal orientation between the front member 26 and the left member 15. Similarly, the right crossbar 18 includes a right end this is coupled with the right member 16. Right crossbar 18 includes a forward end that is coupled with the front member 26. Right crossbar 18 extends and is oriented at a diagonal relationship between the front member 26 and the right member 16. When the crossbars 17, 18 are formed as a singular unit, as shown in FIG. 3, the forward end of each crossbar is a common forward end of the singular unit defined by the two crossbars that couples with the front member 26. The singular unit defined by the left crossbar 17 and the right crossbar 18 is positioned forwardly from the crossbar 14 that extends laterally between the left member 15 and the right member 16.

Each of the crossbars 17, 18 may define slots that extend fully through each crossbar from its upper surface to its lower surface. The slots may have a length that is oriented in a similar diagonal relationship between the front member 26 and one of the side members. For example, with respect to the left crossbar 17, two slots are formed in the left crossbar 17. As will be described in greater detail herein with respect to FIG. 6A and FIG. 6B, a first slot may be associated with a 3-ring gear in the gear assembly 27 and a second slot may be associated with a 13-ring gear of the gear assembly 27. Each slot has selection sub slots formed therewith. For example, the first slot includes selection sub slots 71 for the 3-ring gear and the second slot includes selection sub slots 72 for the 13-ring gear.

Figure 4:
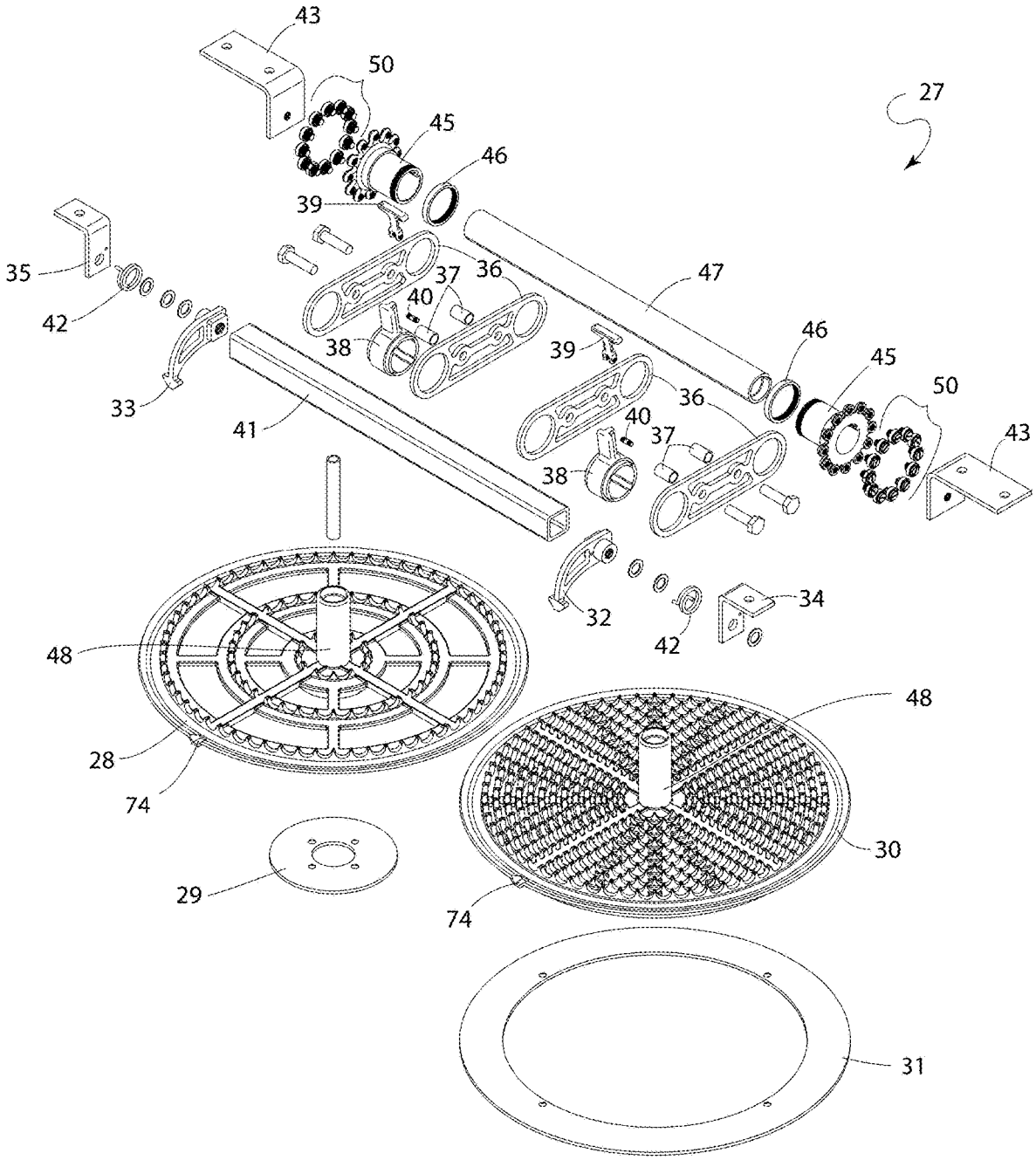
FIG. 4 is an exploded perspective view of one of the gear system subassemblies that is part of each of the two resistance force systems.

FIG. 4 is an exploded perspective view of the gear system subassembly 27. Gear system subassembly 27 may include some of the following components: a gear bracket 43, a spherical plain bearing 50, a pinion 45, a pinion lock ring 46, a pinion driveshaft 47, a brake connector 36, a brake connector spacer 37, a brake lever 38, a brake lever handle 39, a brake lever handle pin 40, a brake shaft 41, a brake spring 42, a gear shaft spacer 44, a pinion shaft spacer 48, a first concentric ring face gear 28, a first gear collar 29, a second concentric ring face gear 30, a second gear collar 31, a first brake 33, a second brake 32, a second brake bracket 34, and a first brake bracket 35.

It is to be understood that the gear system subassembly 27 shown in FIG. 4 is one of the two gear subassemblies 27 within the assembly 1. Thus, reference will be made to the gear system subassembly 27 but it is to be understood that a second gear system subassembly is present within the internal volume of the platform housing 102 on assembly 1. Effectively, the gear system subassembly 27 shown in FIG. 4 is associated with one of the handles 78 to create the exercise resistance for the left side of the assembly 1 and a duplicate gear system assembly would be positioned adjacent these components to provide the exercise resistance for another handle 78 on the right side of the assembly 1.

With continued reference to FIG. 4, each gear system subassembly 27 may include a first face gear comprising at least one concentric gear ring and a second face gear comprising at least one concentric gear ring. In one exemplary embodiment, the first face gear 28 has a first plurality of concentric gear rings and the second face gear 30 has a second plurality of concentric gear rings, wherein the first face gear and the second face gear are in operative communication with each other via the pinion driveshaft 47. In one example, the first face gear has three gear rings and is therefore referred to as 3-ring gear 28 and the second face gear has thirteen gear rings and is therefore referred to as the 13-ring gear 30. However, it should be extremely clear that the number of gear rings on each respective face gear is merely exemplary for the purpose of this disclosure and any plurality of gears is possible and envisioned to be within the scope of the present disclosure. For example, instead of the first face gear 28 having 3 concentric ring gears, it may have two, four, five, six, seven, eight, nine, ten, eleven, twelve or more concentric gear rings. Further to this example, instead of the second face gear 30 having 13 concentric gear rings, it may have two, three, four, five, six, seven, eight, nine, ten, eleven, twelve, fourteen or more concentric gear rings. In this example, the number of gear rings in each respective plurality differs, however it is possible for the number of gear rings on each face gear to be the same. For example, for simplicity purposed, there could be two, three, four, five, six, seven, eight or more gear rings on each face gear.

In the shown embodiment, the first face gear is the 3-ring gear 28 in which the at least one concentric gear ring has three concentric ring gears. The second face gear is embodied as a 13-ring gear 30 in which at least one concentric gear ring has 13 ring gears. In this example, the gear face of both the 3-ring gear 28 and the 13-ring gear 30 face the same direction, which is vertically upward when the platform housing 102 is laid flat and horizontally on the ground surface. When installed within the internal volume of the platform housing 102, both sets of rings on each gear 28, 30 face the same direction. In the shown embodiment, the rings on the respective gears 28, 30 face upwardly in the vertical direction. The lower surface of the 3-ring gear 28 is mounted to the 3-ring collar 29. The lower surface of the 13-ring gear 30 is mounted to the 13-ring collar 31. Collar 29 has a smaller diameter than collar 31. Each gear 28, 30 has a spacer 48 that extends upwardly from the vertical or upwardly facing face containing the concentric gear rings. As will be described in greater detail below, the gear 28 and the gear 30 cooperate to interact with two respective cables, each cable wound around the circumference or another portion of each respective gear. One of the cables is also in operative communication with the pulley assembly 52 that is connected to a resistance mechanism, which according to on exemplary embodiment is a gas strut 53 to impart a resistance to the cable when pulled in an exercise motion by the user.

With continued reference to FIG. 4, the drive or pinion driveshaft 47 is supported on each end thereof by gear brackets 43 that rest atop the pinion shaft spacer 48 coupled to each gear 28, 30. The pinion driveshaft 47 is an elongated cylindrical member that receives the pinion 45 and pinion lock right there around. In one particular embodiment there are two pinions 45, wherein each of the pinions 45 is located near a respective end of the pinion driveshaft 47. The lock rings 46 may couple the pinion 45 to the pinion driveshaft 47. On the pinion 45, there may be a plurality of spherical plain bearings 50. There may be one spherical plain bearing 50 located on each respective tooth of the pinion 45. The plain bearings on the pinion 45 are configured to interact with the corresponding cogs or teeth on the ring gears on the either gear 28 or gear 30.

In one particular embodiment, the bearing 50 is a radial spherical plain bearing. Specifically, in this embodiment, the bearing 50 is not a ball bearing or a roller bearing. Radial spherical plain bearings (also known as GE bearings) are specialized bearings designed to accommodate radial loads and combined radial and axial loads. Radial spherical plain bearings excel in applications where relative motion occurs between components, such as linkages, pivots, and mechanical systems. Radial spherical plain bearings have an inner ring, an outer ring, and a sliding surface and/or sliding material disposed between the two rings. The inner ring has a sphered convex outside diameter. The outer ring has a correspondingly sphered but concave inside surface. These features allow for movement and alignment between the various components. The sliding surface or material typically comprises a layer of PTFE (Polytetrafluoroethylene) bonded to a steel backing. The PTFE layer provides low friction and self-lubricating properties. Some variants of a radial spherical plain bearing may use other materials like sintered bronze or fabric-reinforced PTFE. Radial spherical plain bearings can handle both static and dynamic loads. Their load capacity depends on the specific design and material. The basic dynamic load rating (often denoted as C) is a parameter for spherical plain bearings. The basic dynamic load rating C represents the maximum load that a bearing can accommodate at room temperature when there is relative movement between the sliding contact surfaces. Some factors influencing the basic dynamic load rating include: specific load factor K, which accounts for the type of load (radial, axial, or combined); and effective projected sliding surface, which is the actual area of contact between the bearing surfaces. The basic static load rating (often denoted as Co) represents the maximum permissible load that a bearing can withstand when there is no relative movement between the sliding surfaces (i.e., static load). For spherical plain bearings, Co ensures that the bearing can handle the load without inadmissible deformation, fracturing, or damage to the sliding surfaces.

There are significant differences and advantages of radial spherical plain bearings compared to ball bearings and/or roller bearings. Ball bearings and roller bearings each have rolling elements, whereas the radial spherical plain bearings have no such rolling elements. Ball bearings use spherical balls as rolling elements. These have a limited load capacity due to the small contact area. Roller bearings use cylindrical, spherical, tapered, or needle rollers. These have a load capacity greater than a ball bearing but is still limited. Contrastingly, radial spherical plain bearings have line contact between the sliding surfaces. The line contact results in greater load capacity than bearings with rolling elements. Radial spherical plain bearings also offer higher shock resistance due to line contact.

As will be described in greater detail below, the pinions 45 can move axially along the length of the pinion driveshaft 47 based on user selected input for moving the positioning of the pinions to correspond to a gear ring on one of the gears 28, 30. Namely, a user may slide the pinion 45, when it is unlocked, along the axial length of the pinion driveshaft 47 to cause one of the gear rings on the 3-ring gear 28 to interact with the spherical plain bearings 50. Similarly, the other pinion 45 that is operatively connected to the 13-ring gear 30 may be slid or moved along the axial length of the pinion shaft in response to user selected input to engage the spherical plain bearings 50 with one of the concentric gear rings on the face of the 13-ring gear 30.

The pinions 45 may be retained on the pinion shaft between opposing pairs of the brake connectors 36. Brake connectors 36 may be formed as a generally elongated member having rounded ends wherein one end of the brake connector 36 is formed with a circular aperture that is configured to receive the pinion shaft therethrough. The pair of brake connectors 36 interact with the collar of the pinion 45 and mount thereon. Between the pair of brake connectors 36 may be the brake connector spacer 37 that space apart a pair of brake connectors 36. Adjacent to the other end of the brake connectors 36 is a space in which the brake lever 38 is disposed.

The brake lever 38 has a generally cylindrical collar with an upwardly extending protrusion. The brake handle 39 couples with the upwardly extending protrusion via pin 40. The internal configuration of the collar may be any configuration that is configured to receive the brake shaft 41 therethrough. Brake shaft 41 is offset parallel to pinion driveshaft 47 and operatively connected via brake connectors 36. The shown embodiment depicts that the brake lever 38 has a cylindrical exterior profile, and as such the interior profile of the cylindrical member may have a slot that corresponds to a corner of the square shaped tubing configuration of the brake shaft 41. However, the brake lever may have any configuration that is complementary to the brake shaft 41. This allows the brake shaft 41 to be inserted through the bore of the collar of the brake lever 38. This also allows rotation of the brake lever to cause the brakes 33 and 32 to move in response to operative movement of the brake lever 38. Namely, brake 33 and brake 32 are fixedly connected to respective ends of the brake shaft 41 which extends through the central bore of the brake lever 38. Thus, as the brake lever 38 is rotated via movement of handle 39, the rotational action of the brake lever 38 causes the brakes 32 and 33 to move therewith due to the fixed connection with shaft 41.

Each brake 32, 33 on the end of the brake shaft 41 may be also rotatably connected with a respective brake bracket.

More particularly, the brake 33 for the 3-ring gear is connected with the brake bracket 35. The end of each brake 32, 33 may be formed with a triangular configuration that is configured to be inserted into a corresponding detent 74 in the perimeter of one of the gears. Stated otherwise, the 3-ring gear 28 has a detent 74 formed near the perimeter or circumferential edge thereof. That detent 74 interacts with the end or brake pad 73 of the 3-ring brake 33. Similarly, the perimeter edge or circumferential edge of the 13-ring gear 30 has detent 74 that interacts with the end or brake pad 73 of the 13-ring brake 32. The brakes 32, 33 move in response to manipulation of brake lever 38 from the engaged position (i.e., locked) to a disengaged position (i.e., unlocked), cf. FIG. 9A-9B. When the user wants to lock the brakes in the locked position, those brakes 32, 33 may be assisted by a brake spring 42 which biases the brakes towards the closed position. Thus, in order to move the brakes 32, 33 from the locked position to the unlocked position, the user will manipulate the brake lever 38 by operation of handle 39 against the biasing force of spring 42.

Figure 5:
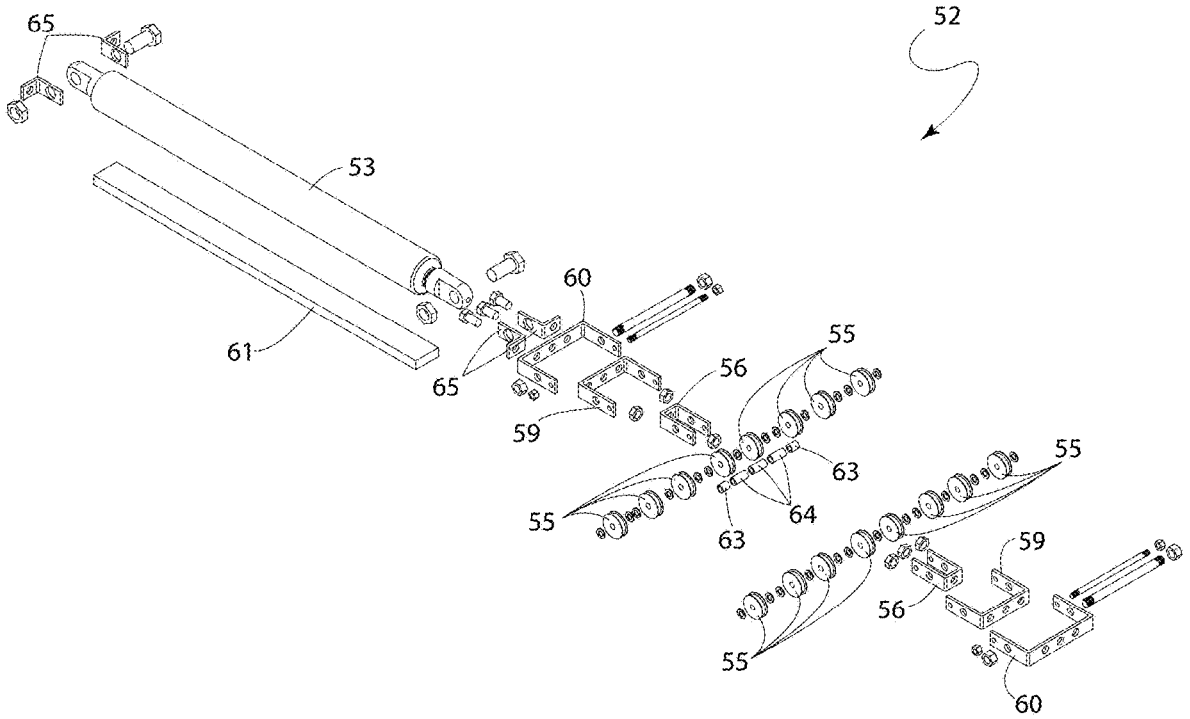
FIG. 5 is an exploded perspective view of the gas strut, hoist and pulleys that are components of each of the two resistance force systems.

FIG. 5 depicts the pulley subassembly 52. The pulley subassembly 52 is one of the two pulley subassemblies that are present within the internal volume of the assembly 1. Thus, the singular pulley assembly 52 shown in FIG. 5 is to be understood as one of the pulley assemblies, the other of which is identical and is operatively connected to the other gear subassembly system 27, and therefore not repeated for brevity.

Pulley subassembly 52 includes a strut bracket 65 that couples to an end of the strut 53. The other end of the strut 53 is coupled via a connector, such as a bolt and screw, to another strut bracket 65. As one having ordinary skill in the art would understand the strut 53 is configured to extend its piston relative to its cylinder when the end of the strut 53 is pulled. Then, when tension is released from the end of the strut 53, the strut will retract its piston into its cylinder towards its collapsed state. An 8-pulley bracket 60 is connected to one of the strut bracket 65. The 8-pulley bracket 60 supports 8 pulleys 55 thereon. The 8-pulley bracket is a generally U-shaped rigid member that is configured to receive a pulley axle bolt therethrough to thereby align the 8 pulleys along the same common axis. Between the respective legs of the U-shaped bracket 60 is a smaller 6-pulley bracket 59. The 6-pulley bracket 59 couples with 6 of the 8 pulleys 55 that are supported by bracket 60. Thus, bracket 59 is a sub-bracket that provides additional support for 6 of the 8 pulleys aligned along the bolt that extends through both the sub-bracket 59 and the bracket 60. There may also be a hoist 56 in operative connection with the central pulleys 55. Each of the pulleys 55 may be spaced apart via spacers 63 and 64. In the shown embodiment, spacer 63 is smaller than the spacer 64 and the larger spacer 64 is located more centrally along the aligned row of pulleys 55 and the smaller spacer 63. When assembled, the pulleys will have the cable 76 wrapped therearound as will be shown in greater detail below with respect to FIG. 10 and FIG. 11.

It should be appreciated that gas strut 53 is one exemplary type of resistance mechanism that could be used in assembly 1. Thus, in addition to the gas strut 53, the term resistance mechanism can encompass and refer to other devices such as elastic bands, weighted plates, magnetic devices, wind resistance devices, or water resistance devices.

Figure 6A:
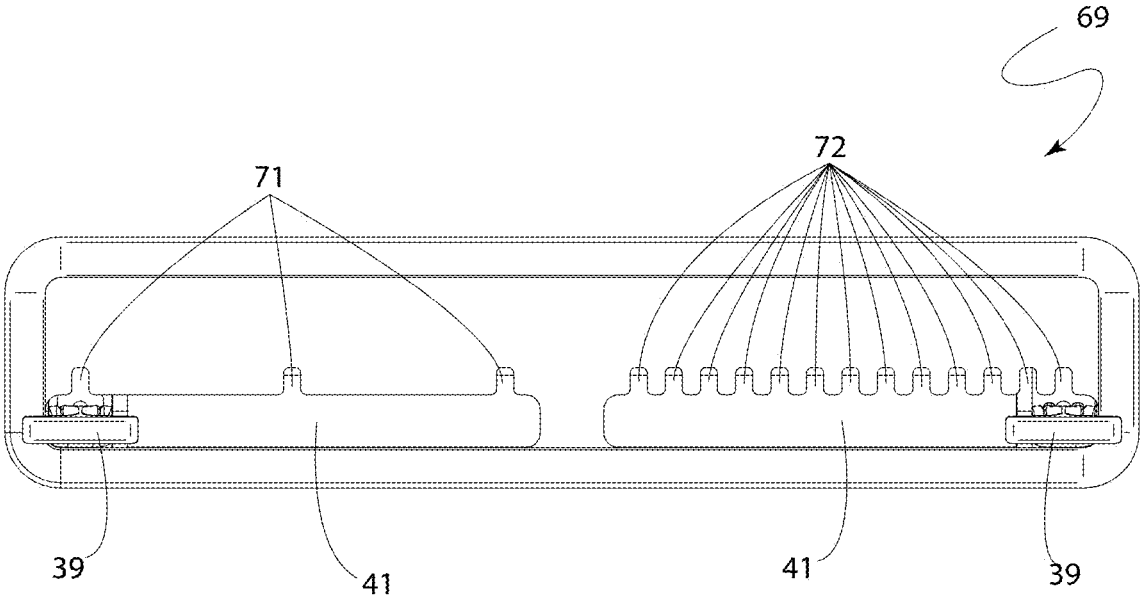
FIG. 6A is an enlarged top plan view of the adjustment mechanism for the force adjustment system depicting the handles in a position that correspondence to one exemplary level of resistance.

FIG. 6A-FIG. 9B depict the operation of the user selection process to engage the different concentric gear rings on the gear system subassembly 27. FIG. 6A depicts the slot formed in the left crossbar 17 and right crossbar 18 of the frame 3. The protruding portion of the lever 38 that is connected with the handle 39 extends upwardly through the slot. With respect to the first slot, the handle 39 of the brake lever 38 may be positioned adjacent the left most sub slot 71 that is associated with the innermost concentric gear ring on the 3-ring gear 28. With respect to the second slot, the handle 39 of another brake lever 38 may be in the rightmost sub slot 72 which is associated with the outermost concentric gear ring of the 13-ring gear 30. A user may actuate the handles 39 to disengage the brake levers 38 from their respective sub slots.

Figure 6B:
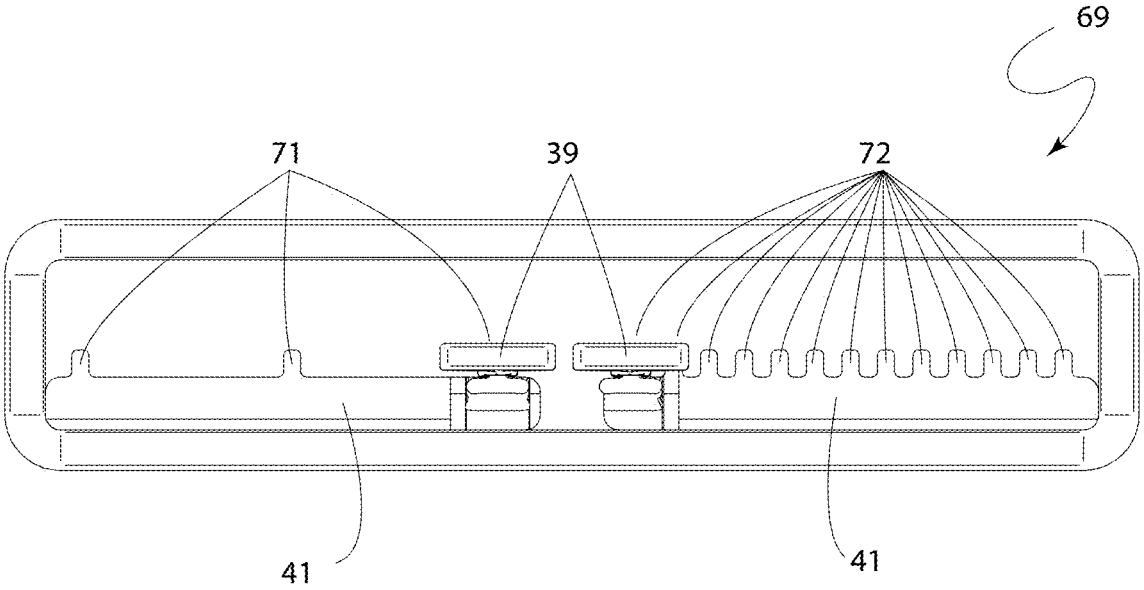
FIG. 6B is an enlarged top plan view of the adjustment mechanism for the force adjustment system depicting the handles in a position that correspondence to another exemplary level of resistance.

FIG. 6B depicts the brake levers 38 having been moved to other sub slots. For example, with respect to the first slot, the brake lever handle 39 has been moved to the rightmost sub slot 71 and engaged in position. With respect to the second slot, the brake handle 39 has been moved to the leftmost position which is associated with the innermost concentric gear ring on the 13-ring gear 30.

Figure 7A:
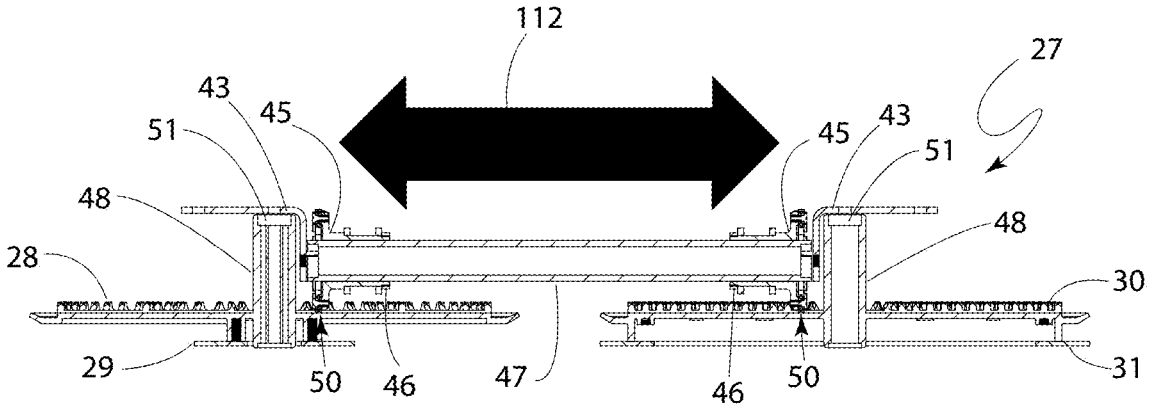
FIG. 7A is an operational elevational cross section view of the gear system assembly that depicts the driveshaft, concentric gears and cog roller toothed gears in a position that corresponds to the positioning of the handles from FIG. 6A.
Figure 8A:
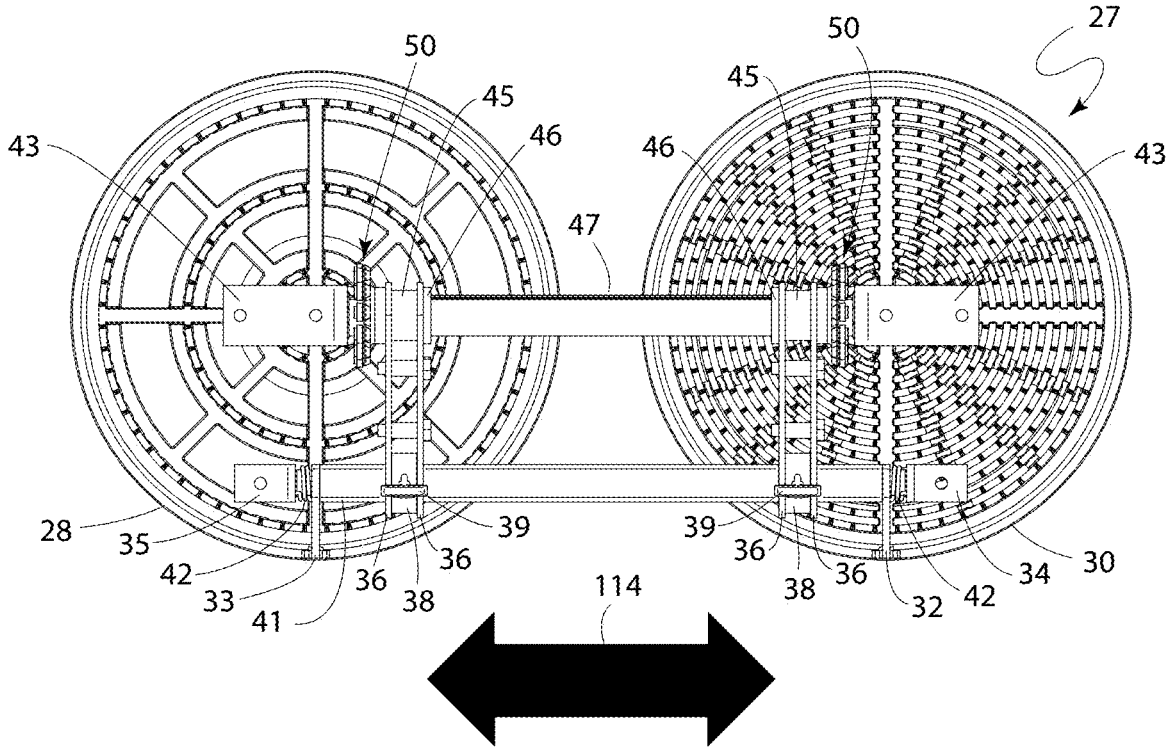
FIG. 8A is an operational top plan view of the gear system assembly that depicts the driveshaft, concentric gears and cog roller toothed gears in a position that corresponds to the positioning of the handles from FIG. 6A and FIG. 7A.

FIG. 7A and FIG. 8A depict the gear system subassembly 27 that corresponds to the positioning of the brake handle 39 shown from FIG. 6A. Namely, when the brake handle 39 in the first slot is in its leftmost position, the pinion 45 and its associated spherical plain bearings 50 are at the radial innermost gear ring of the 3-ring gear 28 that is mounted upon ring collar 29. When the brake handle 39 in the second slot is at its rightmost position, the pinion 45 and its associated spherical plain bearings are engaged on the radial innermost concentric ring of the 13-ring gear 30 which is mounted upon ring collar 31. Arrow 112 indicates that the pinions 45 associated with each respective gear 28, 30 can move to any selected position corresponding to one of the ring gears on that gear.

Figure 7B:
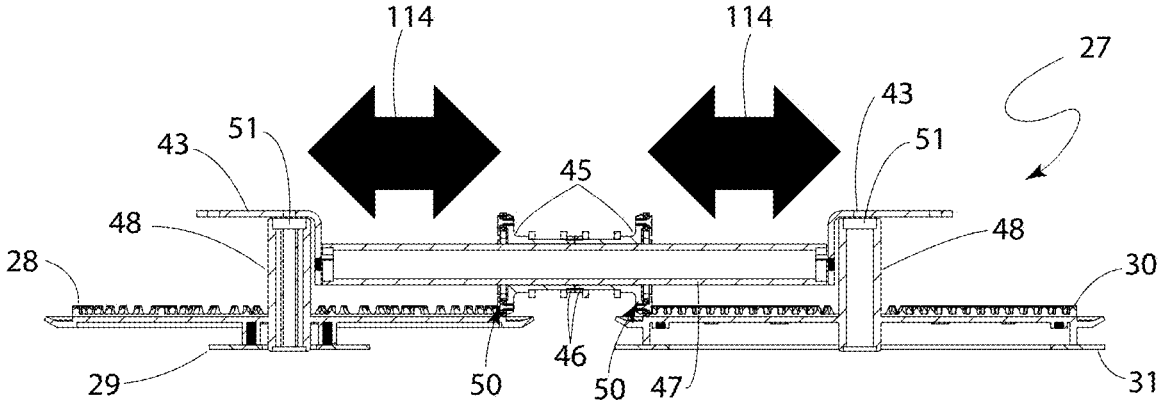
FIG. 7B is an operational elevational cross section view of the gear system assembly that depicts the driveshaft, concentric gears and cog roller toothed gears in a position that corresponds to the positioning of the handles from FIG. 6B.
Figure 8B:
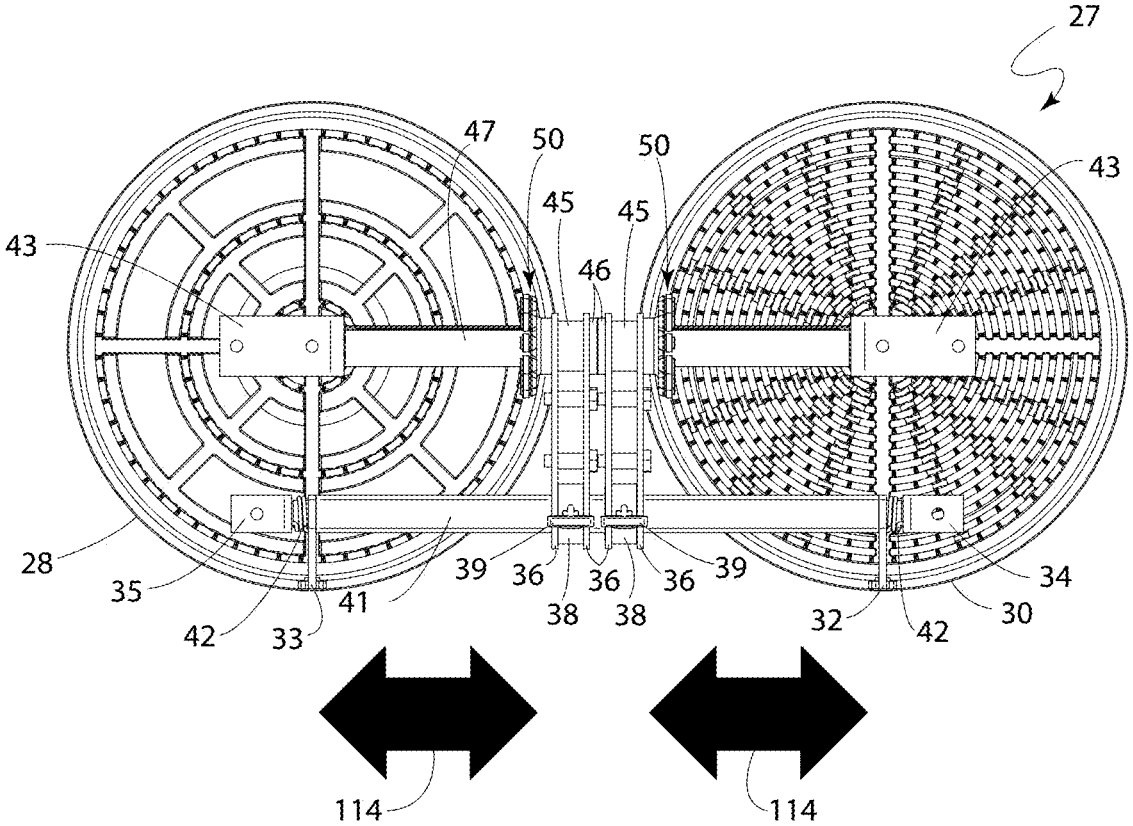
FIG. 8B is an operational top plan view of the gear system assembly that depicts the driveshaft, concentric gears and cog roller toothed gears in a position that corresponds to the positioning of the handles from FIG. 6B and FIG. 7B.

FIG. 7B and FIG. 8B depicts the movement of the pinions as indicated by arrow 114 that corresponds to the positioning of the brake levers shown in FIG. 6B. Namely, when the brake handle 39 in the first slot is engaged with the rightmost sub slot 71, the pinion 45 is engaged with the radial outermost concentric ring gear on the 3-ring gear 28. The brake handle 39 in the second slot is engaged with the leftmost sub slot 72 which corresponds to positioning the pinions 45 with the radial outermost concentric gear on the 13-ring gear 30.

Figure 9A:
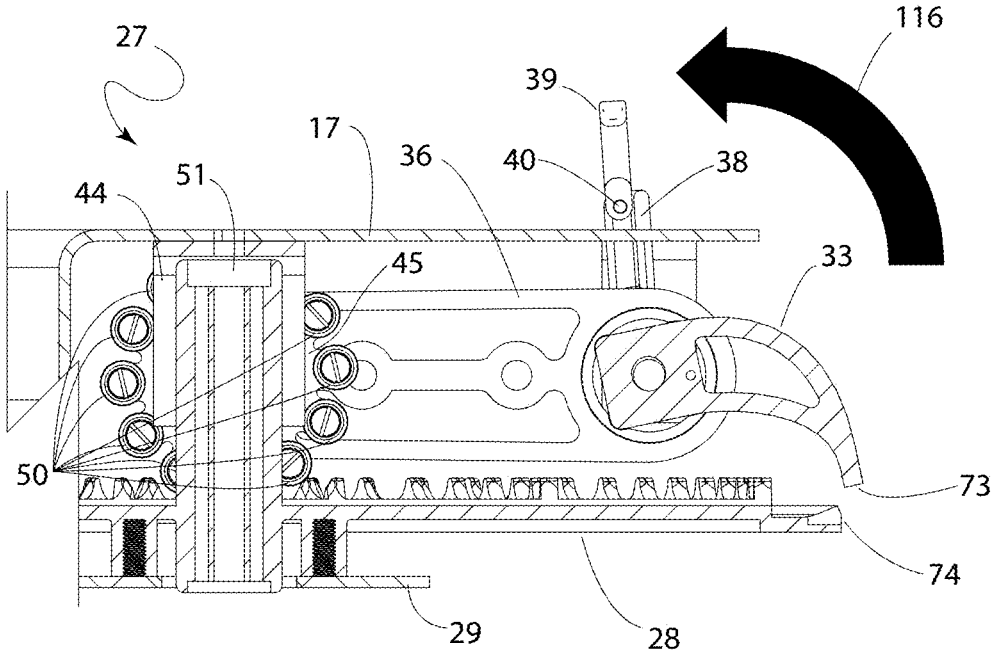
FIG. 9A is an operational side cross section view of the lever and gear brake in an unlocked position.

FIG. 9A depicts that the brake pad 73 has been raised from the brake detent 74 thereby allowing the pinion 45 to slide along the pinion driveshaft 47 as previously indicated with respect to FIG. 7A-FIG. 8B. When the brake lever 38 is pulled back, as indicated by arrow 116, the gear brake is open so the gear can rotate. This also ensures the cable does not unwind while the force is adjusted by sliding the pinion to a different location along pinion driveshaft 47. After the user has selected which sub slot, either 71 or 72, that they want to engage for a selected gear ratio, the brake may be reengaged or locked.

Figure 9B:
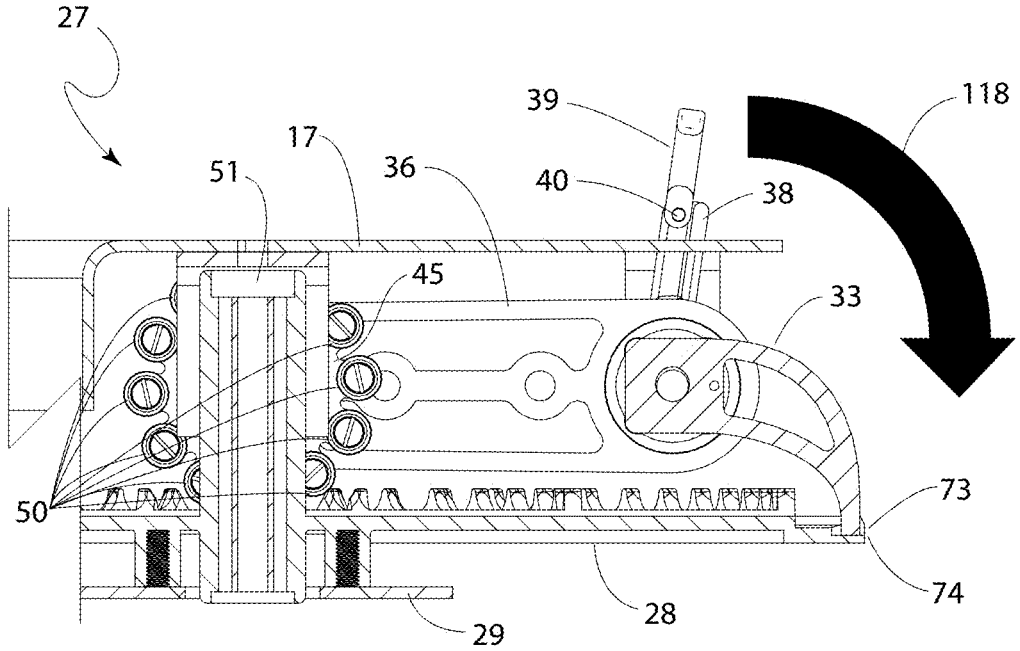
FIG. 9B is an operational side cross section view of the lever and gear brake in a locked position.

FIG. 9B depicts the engagement of the brake with the gear ring. Particularly, to engage the brake with the gear ring, the user will rotate the handle 39 of the brake lever 38 as indicated by arrow 118. This shall cause the brake pad 73 to lower and engage the detent 74 on the gear 28. A similar action occurs of the brake pad engaging the brake detent on the 13-ring gear when it is manipulated in a similar manner.

Collectively, FIG. 9A and FIG. 9B depict the operation of the brake portion of the gear system subassembly 27. Particularly, FIG. 9A and FIG. 9B depict the operation of the 3-ring brake 33. However, it is to be understood that the operation of the 13-ring brake 32 operates in a similar manner. To disengage the brake pad 73 on the brake 33, the handle of the lever 38 will be raised as indicated by arrow 116. When the user moves the handle 39 as indicated by arrow 116, this causes the cylindrical collar of the brake lever 38 to rotate about its axis. The internal components of the cylindrical collar are slidably engaged with the brake shaft 41, however the internal configuration of the collar of the brake lever 38 causes or imparts rotational movement to the brake shaft 41 in response to manual manipulation of the handle 39. Thus, when rotation of the brake lever 38 occurs, rotation is imparted to the brake shaft 41. Since each of the brakes 32, 33 are fixedly connected to the ends of the brake shaft 41, when the brake shaft rotates about its axis the brake 33, as well as the brake 32, will also rotate about the axis. The rotation of the brake shaft 41 shall overcome the biasing spring force applied by spring 42 that is configured to bias the brakes 32, 33 back to the engaged and locked position when the lever is released. As such, it is to be understood that spring 42 is a torsion spring that has a neutral position associated with the lever 38 being locked, and the spring can be biased out of the neutral position to unlock the brake. This loads the spring with potential energy that, when the brake lever is released, biases back to its neutral position.

Figure 10:
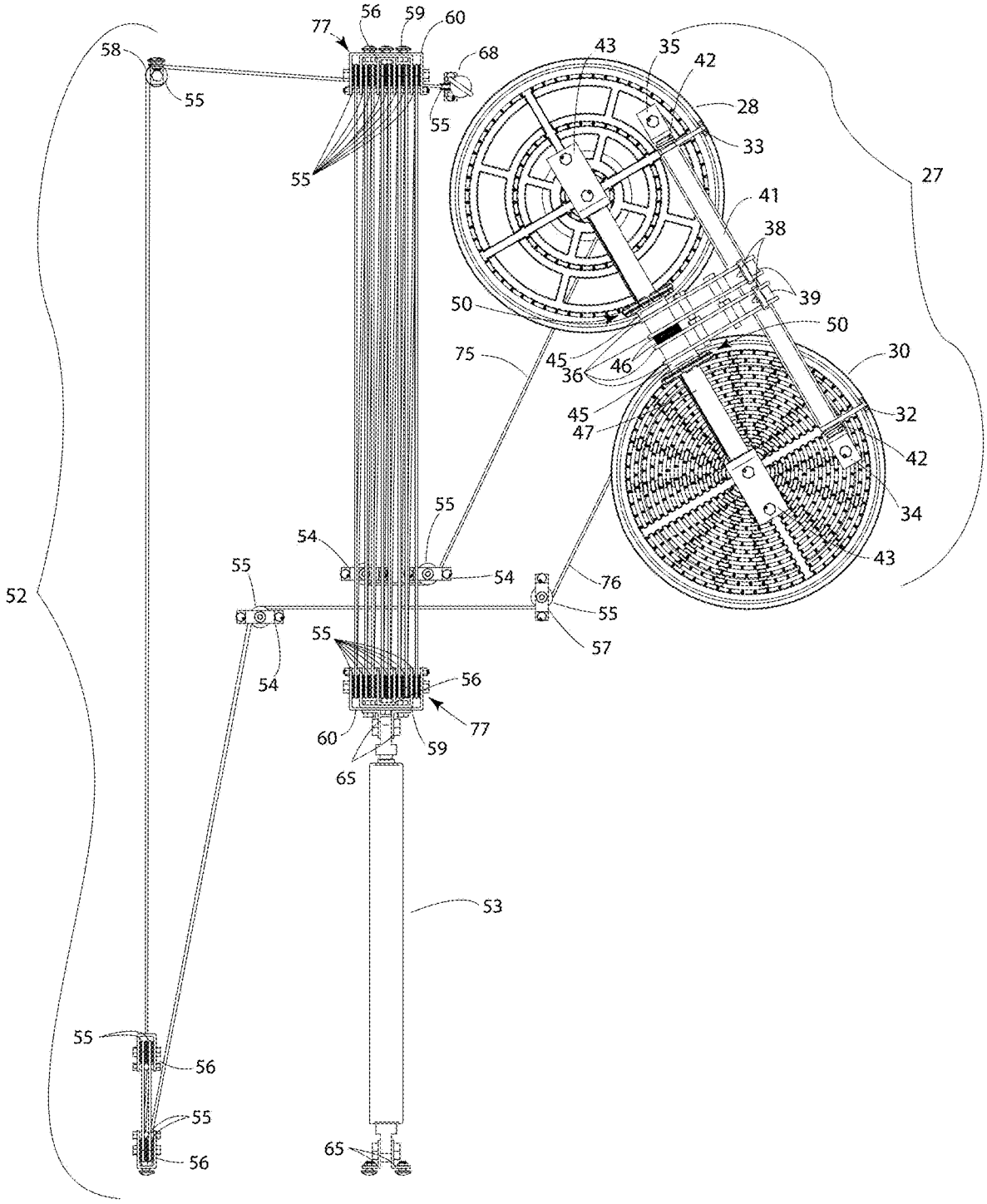
FIG. 10 is a top plan view of one gear system subassembly coupled via cabling to the resistance assembly having the gas strut.

FIG. 10 depicts the operational engagement of one of the gear system subassemblies 27 and the pulley subassembly 52. These cooperate to provide one of the exercise resistance points atop the platform such that the handle would connect with the attachment point 68. Insofar as the assembly 1 has to attachment points 68, and as shown in FIG. 2, it is to be understood that there is a duplicate gear system subassembly 27 and connected pulley assembly 52 on the other side of the assembly 1. In FIG. 10, the shown configuration of the gear system subassembly 27 and the pulley assembly 52 is associated with the left side of the assembly 1. Thus, it is understood that the right side configuration of the gear system subassembly 27 and pulley assembly 52 which are not shown in FIG. 10, would be configured in a similar manner, but mirrored for the other side of assembly 1.

FIG. 10 depicts the configuration of the gear system subassembly 27. The gear system subassembly 27 cooperates with the pulley subassembly 52 and the gas strut 53 to create a resistance when the handle 78 is pulled by an operator standing atop top platform surface 4 during an exercise movement. The handle 78 connects with the attachment point 68. The attachment point 68 is connected with an end of the cable 76. The cable 76 is strung through a plurality of pulleys 55 in the manner shown. The pulleys 55 may be connected with various brackets 58 and hoists 56 that are located within the internal volume of the assembly 1. Other pulleys 55 may also be connected to with a stacked pulley bracket 54 in the manner shown. The cable 76 extends through the pulleys to an end that is coupled with the 13-gear ring 30. The manner in which the end of the cable 76 is connected with the 13-ring gear 30 enables the handle 78 to be operatively connected to the 13-ring gear 30. Thus, when a user pulls on the handle 78, the cable moves through the pulleys 55 to cause rotation to the 13-ring gear 30. The rotational movement of the 13-ring gear 30 in response to the cable 76 being pulled by the handle 78 imparts a rotational action to the pinion 45 that is connected to one of the concentric gear rings in the 13-ring gear 30. Rotation of the pinion 45 imparts rotation to the pinion driveshaft 47. Rotation of the of the pinion driveshaft 47 imparts rotation into the second pinion 45 that is operatively connected to one of the concentric gear rings in the 3-ring gear 28. Rotation of the pinion 45 that is connected with the 3-ring gear 28 causes the 3-ring gear 28 to rotate.

The 3-ring gear 28 is connected with another cable 75. Thus, when the 3-ring gear 28 rotates, it causes the cable 75 to move by pulling the cable 75. Cable 75 extends from its end that is connected with the 3-ring gear 28 through a pulley 55 coupled to a stacked pulley bracket 54. The cable 75 thereafter winds or is strung about two pulley hoists 56 that are connected with the 6-pulley bracket 59 and the 8-pulley bracket 60. Cable 75 winds around the pulleys 55 in the pulley hoist 56 to a terminal end of the cable 75 that is connected with one of the pulley assemblies 77. As shown, one pulley assembly is connected to the strut bracket 65 that is connected with a piston of the strut 53. Thus, rotational action of the 3-ring gear 28 effectuates movement of the cable 75 to cause the pulley assembly 77 that is coupled with the piston of the strut 73 to be pulled closer to the fixed pulley assembly 77 that is mounted to the frame 3. Movement of the pulley assembly connected to the strut 53 requires a resistance to overcome the force required to extend the strut 53 from its collapsed position to its extended position. This resistance required to overcome the force of the strut 53 is what creates the exercise weight or resistance observed by the user of the assembly 1, together with the gear ratio of the two gears 28, 30.

The user of the assembly 1 can vary the observed resistance based on the gear ratio of the 13-ring gear 30 and the 3-ring gear 28. Stated otherwise, the gas strut is a fixed strut that has a certain amount of force to overcome or extend the piston relative to the cylinder. However, the ratio of the gears of the 3-ring gear 28 and the 13-ring gear 30 may be selectively set by the user to determine the observed force for the exercise. For example, the position of the pinions shown in FIG. 10 would correspond to the one exemplary resistance of the assembly 1. However, if the pinions are slid and maneuvered to the orientation shown in FIG. 8A and FIG. 7A this would correspond to another exemplary resistance that is different than the position shown with respect to FIG. 10.

Figure 11:
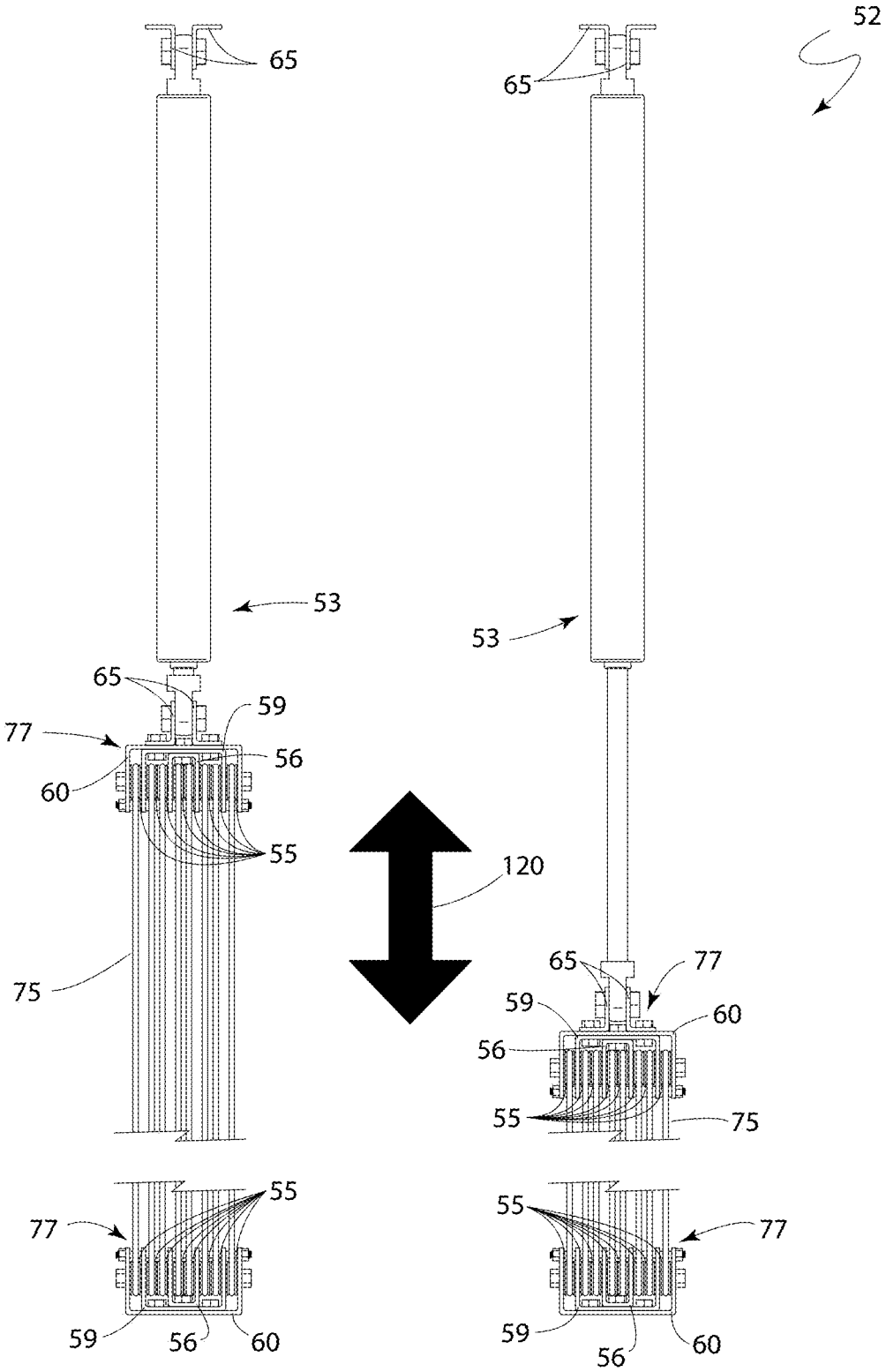
FIG. 11 is a top plan view of the resistance force system depicting the movement of the gas strut relative to the cable.

FIG. 11 depicts the operation of the strut 53 being moved from its collapsed position to its extended position as indicated by arrow 120. The extension of the piston from the strut occurs in response to the movement of cable 75 which is caused by the rotational action of the 3-ring gear 28.

Figure 12:
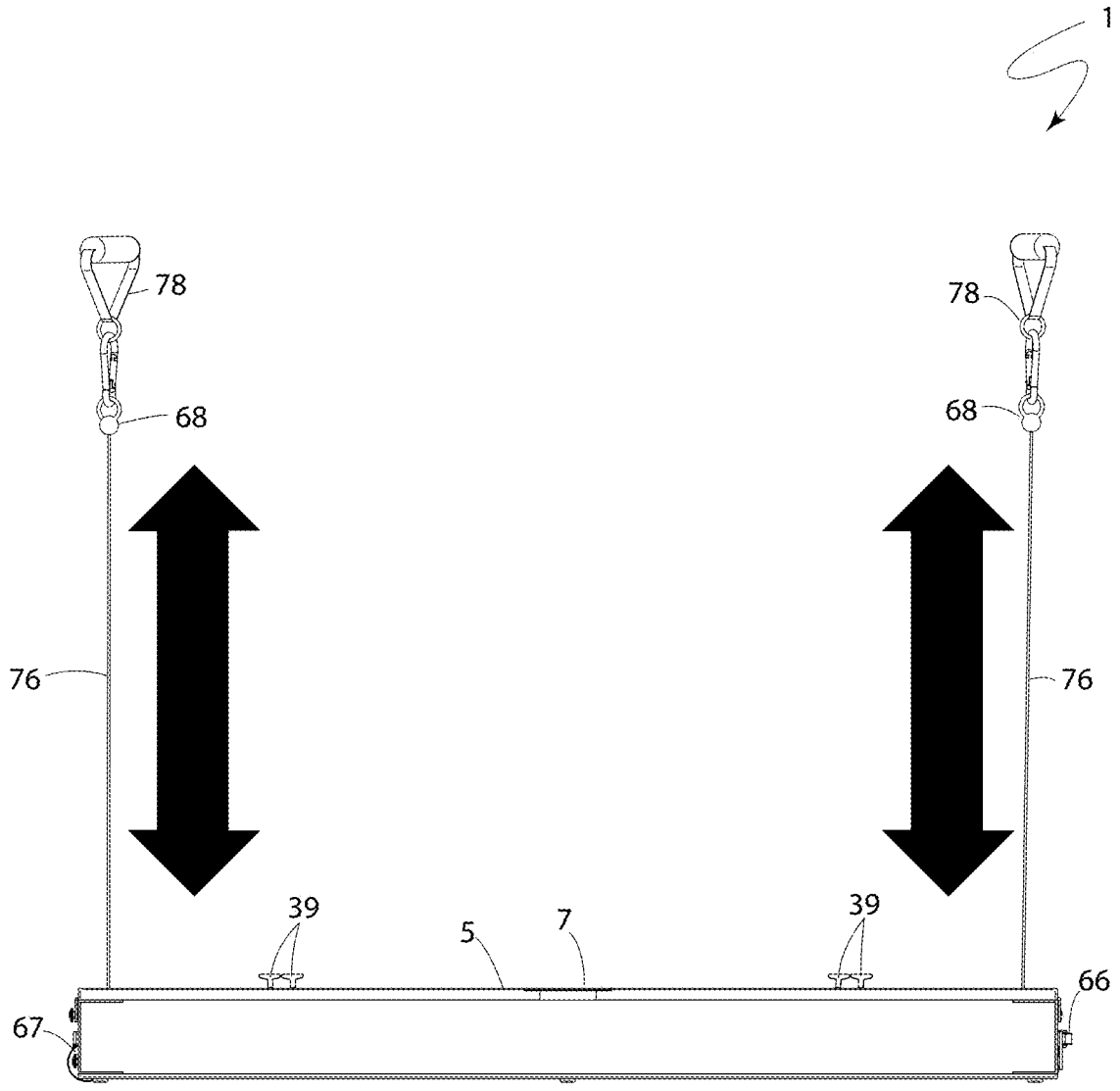
FIG. 12 is an operational side elevation view of the resistance exercise platform.

FIG. 12 depicts the operation of the assembly 1. As was previously mentioned, the assembly has to handles 78 and each handle 78 corresponds to an independent or distinct gear system subassembly 27. Thus, while reference was previously made to only a single or one of the gear system subassemblies 27 in FIG. 10 and FIG. 11, it is to understand that the other handle 78 would be similarly coupled to another gear system subassembly as shown in FIG. 12.

Throughout the figures, the top platform surface 4 has been shown in a manner that would enable a user of the exercise assembly 1 to stand upon or near the top platform surface to perform an exercise that pulls on the handles 78. Such exemplary exercises include a bicep curl, a deadlift, a shoulder press, a shoulder shrug, a lateral raise, or the like. Another manner in which the user of the exercise assembly 1 can stand upon or near the top platform surface 4 would be during a squat exercise. A barbell would couple with the attachment points 68 or handles 78. Then, the user can perform a squat exercised against the selected resistance imparted by the assembly 1. For a squat exercise, it may be advantageous for the assembly 1 to include or be coupled with a squat rack having at least one upwardly extending support beam or pole. The upwardly extending support beam or pole could couple directly to the frame 3 or the upwardly extending support beam or pole could be placed on the floor adjacent to the frame without being physically connected. The squat rack could then support the barbell when not in use.

In addition to the foregoing, it is also possible to perform different exercises with assembly 1 in which the user is engaging the assembly 1, either directly or indirectly, without necessarily standing upon the top platform surface. In each of these other scenarios, the top platform surface supports the user, either directly or indirectly. For example, a user can place a bench atop the top platform surface 4. In this instance, the top platform surface 4 indirectly supports a user during a bench press exercise in which the user lies on the bench (which directly supports the user) and presses the handles 78 upwardly against the selected resistance. In another scenario, a user may lie down on the top platform surface to perform an abdominal exercise. In this instance, the top platform surface 4 directly supports the user during an abdominal exercise while the user is holding the handles 78 to move against the selected resistance during that abdominal exercise (e.g., performing a crunch). Each of these exemplary scenarios, amongst others, details how a user engages, directly or indirectly, the platform housing 100 of the exercise assembly 1.

The device, assembly, or system of the present disclosure may additionally include one or more sensors to sense or gather data pertaining to the surrounding environment or operation of the device, assembly, or system. Some exemplary sensors capable of being electronically coupled with the device, assembly, or system of the present disclosure (either directly connected to the device, assembly, or system of the present disclosure or remotely connected thereto) may include but are not limited to: user vital data monitors, such as heart rate monitors, accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; global positioning sensors sensing location, elevation, distance traveled, velocity/speed; audio sensors sensing local environmental sound levels, or voice detection; photo/light sensors sensing ambient light intensity, ambient, day/night, UV exposure; TV/IR sensors sensing light wavelength; temperature sensors sensing machine or motor temperature, ambient air temperature, and environmental temperature; radar sensors; lidar sensors; ultrasonic sensors; magnetic sensors, image sensors; and moisture sensors sensing surrounding moisture levels.

If sensors are utilized to gather data relating to the assembly 1 of the present disclosure, then sensed data may be evaluated and processed with artificial intelligence (AI). Analyzing data gathered from sensors using artificial intelligence involves the process of extracting meaningful insights and patterns from raw sensor data to produce refined and actionable results. Raw data is gathered from various sensors, for example those which have been identified herein or others, capturing relevant information based on the intended analysis. This data is then preprocessed to clean, organize, and structure it for effective analysis. Features that represent key characteristics or attributes of the data are extracted. These features serve as inputs for AI algorithms, encapsulating relevant information essential for the analysis. A suitable AI model, such as machine learning or deep learning (regardless of whether it is supervised or unsupervised), is chosen based on the nature of the data and the desired analysis outcome. The model is then trained using labeled or unlabeled data to learn the underlying patterns and relationships. The model is fine-tuned and optimized to enhance its performance and accuracy. This process involves adjusting parameters, architectures, and algorithms to achieve better results. The trained model is used to make predictions or inferences on new, unseen data. The model processes the extracted features and generates refined output based on the patterns it has learned during training. The results produced by the AI model are refined through post-processing techniques to ensure accuracy and relevance. These refined results are then interpreted to extract meaningful insights and derive actionable conclusions. Feedback from the refined results is used to improve the AI model iteratively. The process involves incorporating new data, adjusting the model, and enhancing the analysis based on real-world feedback and evolving requirements. Further, AI results can be used to alter the operation of the device, assembly, or system of the present disclosure based on feedback. For example, AI feedback can be used to improve the efficiency of the device, assembly, or system of the present disclosure by responding to predicted changes in the environment or predicted changes to the device, assembly, or system of the present disclosure more quickly than if only sensed by one or more of the sensors.

A sensor model may be employed, once trained, in the device, assembly, or system of the present disclosure. In one embodiment, the device, assembly, or system of the present disclosure can be used to teach a sensor model to predict sensor data for a specific scenario. Alternatively, sensor models can be utilized to generate the data to train the AI. The sensor model can be trained for any type of sensor, such as those types of sensors described above, and/or other sensor types. The elements described herein may be implemented as discrete or distributed components in any suitable combination and location. The various functions described herein may be conducted by hardware, firmware, and/or software. For example, a processor may perform various functions by executing instructions stored in memory.

The AI model and/or sensor model can include a deep neural network (DNN), convolutional neural network (CNN), another neural network (NN) or the like and can support generative learning. For example, the sensor model can include a generative adversarial network (GAN), a variational autoencoder (VAE), and/or another type of DNN, CNN, NN or machine learning model (e.g., natural language processing (NLP)). Generally, the sensor model can accept some encoded representation of a scene as input using any number of data structures and/or channels (e.g., concatenated vectors, matrices, tensors, images, etc.).

In a particular embodiment, the assembly 1 of the present disclosure can use the sensors to acquire a representation of the real-world environment (e.g., a physical environment) or of the vital statistics of the user at a given point in time. Data from these sensors may be used to generate a representation of a scene or scenario, which may then be used to teach a sensor model. For example, a representation of a scene can be derived from sensor data, properties of objects in the scene or surrounding environment such as positions or dimensions (e.g., human positioning during an exercise), classification data identifying objects in the scene or surrounding environment (e.g., which type of user is using the assembly 1), human-user vitals data, properties or classification data of components of the assembly 1 of the present disclosure, or some combination thereof. Generally, the sensor model learns to predict sensor data from a representation of the scene, environment or operation of the assembly 1 of the present disclosure.

The sensor model architecture can be selected to fit the shape of the desired input and output data. Examples of architectures (e.g., DNNs) include, but are not limited to, perceptron, feed-forward, radial basis, deep feed-forward, recurrent, long/short term memory, gated recurrent unit, autoencoder, variational autoencoder, convolutional, deconvolutional, and generative adversarial. Some DNN architectures, such as a GAN, can include a convolutional neural network (CNN) that accepts and evaluates an input image and may include multiple input channels, which may be used to accept and evaluate multiple input images and/or input vectors.

The assembly 1 of the present disclosure may include exercise hardware, software and/or firmware responsible for managing the sensor data generated by the sensors. The autonomous exercise hardware, software, and/or firmware being executed may manage different environments using one or more maps (e.g., 3D maps), positioning component(s), and the like. The autonomous exercise hardware, software, and/or firmware may also include components to plan, control, and generally manage the assembly 1 of the present disclosure. In one example, the autonomous exercise hardware, software, and/or firmware can be installed in and used to control the assembly 1 of the present disclosure through the environment or the effort of the human-operator based on the sensor data, one or more machine learning models (e.g., neural networks), and the like. A training system may use the training data to train the sensor model to predict virtual sensor data for a given scene, environment, or operation of a component.

The training system can include one or more servers (e.g., a graphics processing unit server) and data stores and may use a cloud-based deep learning infrastructure with artificial intelligence to analyze the sensor data received from the assembly 1 of the present disclosure and/or stored in the data store. The training system can also incorporate or train up-to-date, real-time neural networks (and/or other machine learning models) for one or more sensor models.

The assembly 1 of the present disclosure may include wireless communication logic coupled to sensors on the assembly 1. The sensors gather data and provide the data to the wireless communication logic. Then, the wireless communication logic may transmit the data gathered from the sensors to a remote device. Thus, the wireless communication logic may be part of a broader communication system, in which one or several devices, assemblies, or systems of the present disclosure may be networked together to report alerts and, more generally, to be accessed and controlled remotely. Depending on the types of transceivers installed in the device, assembly, or system of the present disclosure, the system may use a variety of protocols (e.g., Wi-Fi®, ZigBee®, MIWI, BLUETOOTH®) for communication. In one example, each of the devices, assemblies, or systems of the present disclosure may have its own IP address and may communicate directly with a router or gateway. This would typically be the case if the communication protocol is Wi-Fi®. (Wi-Fi® is a registered trademark of Wi-Fi Alliance of Austin, TX, USA; ZigBee® is a registered trademark of ZigBee Alliance of Davis, CA, USA; and BLUETOOTH® is a registered trademark of Bluetooth Sig, Inc. of Kirkland, WA, USA).

The system that receives and processes signals from the device, assembly, or system of the present disclosure may differ from embodiment to embodiment. In one embodiment, alerts and signals from the device, assembly, or system of the present disclosure are sent through an e-mail or simple message service (SMS; text message) gateway so that they can be sent as e-mails or SMS text messages to a remote device, such as a smartphone, laptop, or tablet computer, monitored by a responsible individual, group of individuals, or department, such as a maintenance department. Thus, if a particular device, assembly, or system of the present disclosure creates an alert because of a data point gathered by one or more sensors, that alert can be sent, in e-mail or SMS form, directly to the individual responsible for fixing it. Of course, e-mail and SMS are only two examples of communication methods that may be used; in other embodiments, different forms of communication may be used.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Unless explicitly stated that a particular shape or configuration of a component is mandatory, any of the elements, components, or structures discussed herein may take the form of any shape. Thus, although the figures depict the various elements, components, or structures of the present disclosure according to one or more exemplary embodiments, it is to be understood that any other geometric configuration of that element, component, or structure is entirely possible. For example, various components of assembly 1 can be semi-circular, triangular, rectangular or square, pentagonal, hexagonal, heptagonal, octagonal, decagonal, dodecagonal, diamond shaped or another parallelogram, trapezoidal, star-shaped, oval, ovoid, lines or lined, teardrop-shaped, cross-shaped, donut-shaped, heart-shaped, arrow-shaped, crescent-shaped, any letter shape (i.e., A-shaped, B-shaped, C-shaped, D-shaped, E-shaped, F-shaped, G-shaped, H-shaped, I-shaped, J-shaped, K-shaped, L-shaped, M-shaped, N-shaped, O-shaped, P-shaped, Q-shaped, R-shaped, S-shaped, T-shaped, U-shaped, V-shaped, W-shaped, X-shaped, Y-shaped, or Z-shaped), or any other type of regular or irregular, symmetrical or asymmetrical configuration.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Any flowchart and/or block diagrams in the Figures illustrate some exemplary architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, firmware or a combination thereof. When implemented in software, the software code or instructions can be executed on any suitable processor or collection of processors, whether provided in a single computer or distributed among multiple computers or in firmware. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that are executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under", or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present disclosure.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments. Furthermore, the use of any and all examples or exemplary language ("e.g.," "such as," or the like) is intended merely to better illustrate or illuminate the embodiments and does not pose a limitation on the scope of that or those embodiments. No language in this specification should be construed as indicating any unclaimed element as essential to the practice of the disclosed embodiment.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element or "another" element, that does not preclude there being more than one of the additional element or the another element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein. Further, recitation of ranges of values herein are not intended to be limiting, referring instead individually to any and all values falling within that range, unless otherwise indicated herein, and each separate value within such range is incorporated into the specification as if it were individually recited herein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, or in the context of those sections, this term has been included as required by the formatting requirements of word document submissions (i.e., docx submissions) pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. An exercise assembly comprising:

a platform housing comprising a top platform surface adapted to support a user of the exercise assembly, wherein the platform housing defines an internal volume;

a frame that supports the platform housing;

at least one gear system subassembly within the platform housing, wherein the at least one gear system subassembly comprises a first face gear having a first plurality of concentric gear rings and a second face gear having a second plurality of concentric gear rings, wherein the first face gear and the second face gear are in operative communication with each other via a pinion driveshaft;

a resistance mechanism within the platform housing;

a first cable operatively coupled with the first face gear and the resistance mechanism; and a second cable operatively coupled with the second face gear, and an end of the second cable adapted to be manipulated by the user of the exercise assembly to experience a resistance in the second cable imparted from the resistance mechanism through the at least one gear system subassembly.

2. The exercise assembly of claim 1, wherein the concentric gear rings on the first face gear and the concentric gears on the second face gear are facing the same direction.

3. The exercise assembly of claim 1, wherein the concentric gear rings on the first face gear and the concentric gears on the second face gear are oriented in the vertical direction such that first face gear rotates about a first vertical axis and the second face gear rotates about a second vertical axis that is parallel to the first vertical axis.

4. The exercise assembly of claim 1, further comprising:

a first pinion on the pinion driveshaft, wherein the first pinion engages the first face gear;

a second pinion on the pinion driveshaft, wherein the second pinion engages the second face gear; and wherein rotation of the second face gear imparts rotation to the second pinion gear that imparts rotation to the pinion driveshaft, and the pinion driveshaft thereby imparts rotation to the first pinion that imparts rotation to the first face gear.

5. The exercise assembly of claim 1, further comprising:

a first pinion on the pinion driveshaft, wherein the first pinion selectively engages the first face gear at one gear ring in the first plurality of concentric gear rings; and a second pinion on the pinion driveshaft, wherein the second pinion selectively engages the second face gear at one gear ring in the second plurality of concentric gear rings.

6. The exercise assembly of claim 1, further comprising:

a brake shaft operatively coupled to pinion driveshaft, wherein the brake shaft is spaced apart and parallel to the pinion driveshaft.

7. The exercise assembly of claim 6, further comprising:

a first brake fixedly connected to the brake shaft, wherein the first brake selectively engages the first face gear to lock with the first face gear and selectively disengages the first face gear to unlock from the first face gear, wherein a first pinion is selectively moved between concentric gear rings in the first plurality of concentric gear rings when the first brake is unlocked.

8. The exercise assembly of claim 7, further comprising:

a second brake fixedly connected to the brake shaft, wherein the second brake selectively engages the second face gear to lock with the second face gear and selectively disengages the second face gear to unlock from the second face gear, wherein a second pinion is selectively moved between concentric gear rings in the second plurality of concentric gear rings when the second brake is unlocked.

9. The exercise assembly of claim 1, further comprising:

an adjustable and user-selected gear ratio of the first face gear relative to the second face gear depending on a user-selected engagement position of a first pinion with the first face gear and a user-selected engagement position of a second pinion with the second face gear, wherein the resistance from the resistance mechanism that is experienced by the user of the exercise assembly depends on the gear ratio.

10. The exercise assembly of claim 1, further comprising:

wheels coupled to the platform housing, wherein the wheels enable the platform housing to be rolled and transported to a different location.

11. The exercise assembly of claim 1, further comprising:

a second gear system subassembly within the platform housing, wherein the second gear system subassembly comprises a third face gear having a third plurality of concentric gear rings and a fourth face gear having a fourth plurality of concentric gear rings, wherein the third face gear and the fourth face gear are in operative communication with each other via a second pinion driveshaft;

a second resistance mechanism within the platform housing;

a third cable operatively coupled with the third face gear and the second resistance mechanism; and a fourth cable operatively coupled with the fourth face gear, and an end of the fourth cable adapted to be manipulated by the user of the exercise assembly to experience a resistance in the fourth cable imparted from the second resistance mechanism through the second gear system subassembly.

12. The exercise assembly of claim 1, further comprising:

a pulley assembly within the platform housing, wherein the first cable is strung through a first plurality of pulleys and the second cable is strung through a second plurality of pulleys.

13. The exercise assembly of claim 12, further comprising:

one end of the resistance mechanism fixed connected to the frame within the platform housing;

an opposing end of the resistance mechanism coupled to some of the pulleys from the first plurality of pulleys, wherein the resistance mechanism is a gas strut that moves between a collapsed position and an extended position in response to movement of the first cable having been driven by the at least one gear system subassembly.

14. The exercise assembly of claim 13, wherein the gas strut is oriented horizontally relative to a ground surface when the platform housing is placed on the ground surface.

15. The exercise assembly of claim 1, further comprising:

a first aperture formed in the top platform surface of the platform housing;

wherein a portion of the at least one gear system subassembly extends through the first aperture formed in the top surface, wherein the portion of the at least one gear system subassembly that extends through the first aperture is configured to enable a gear-ratio of the first face gear to the second face gear to be changed based on user-selected preference.

16. The exercise assembly of claim 1, further comprising:

a radial spherical plain bearing on one of the first pinion and the second pinion.

17. A method comprising:

engaging, directly or indirectly, a platform housing of an exercise assembly comprising at least one gear system subassembly within the platform housing, wherein the at least one gear system subassembly comprises a first face gear and a second face gear, and the exercise assembly comprising at least a first cable and a second cable;

pulling the second cable outwardly through a hole formed in the platform housing;

rotating the second face gear in response to pulling the second cable;

rotating a second pinion with the second face gear;

rotating a pinion driveshaft in response to rotation of the second pinion;

rotating a first pinion connected to the pinion driveshaft;

rotating the first face gear in response to rotation of the first pinion;

causing the first cable to pull against a resistance mechanism, when the second cable is manipulated by the user of the exercise assembly, the user experiences resistance in the second cable imparted from the resistance mechanism through the at least one gear system subassembly.

18. The method of claim 17, further comprising:

changing a gear ratio of the first face gear to the second face gear in response to one of (i) moving the first pinion along the pinion driveshaft to engage another concentric ring gear on the first face gear, (ii) moving the second pinion along the pinion driveshaft to engage another concentric ring gear on the second face gear, or (iii) both (i) and (ii).

19. The method of claim 17, further comprising:

disengaging a first brake from the first face gear;

moving the first pinion along the pinion driveshaft when the first brake is disengaged;

re-engaging the first brake after moving the first pinion to a different position along the pinion driveshaft.

20. The method of claim 17, further comprising:

imparting rotation to a radial spherical plain bearing on the second pinion in response pulling the second cable; and imparting rotation to a radial spherical bearing on the first pinion in response to rotation of the pinion driveshaft.

* * * * *